US010194780B2

(12) United States Patent
Henao et al.

(10) Patent No.: US 10,194,780 B2
(45) Date of Patent: Feb. 5, 2019

(54) SWEEPING DEVICES, WASTE-RECEIVING DEVICES, AND METHODS OF USING THE SAME

(71) Applicants: Elvis Henao, Fort Collins, CO (US); Viviana Henao, Fort Collins, CO (US)

(72) Inventors: Elvis Henao, Fort Collins, CO (US); Viviana Henao, Fort Collins, CO (US)

( * ) Notice: Subject to any disclaimer, the term of this patent is extended or adjusted under 35 U.S.C. 154(b) by 0 days.

(21) Appl. No.: 15/789,171

(22) Filed: Oct. 20, 2017

(65) Prior Publication Data

US 2018/0116481 A1 May 3, 2018

Related U.S. Application Data

(60) Provisional application No. 62/413,484, filed on Oct. 27, 2016, provisional application No. 62/420,211, filed on Nov. 10, 2016.

(51) Int. Cl.

| | |
|---|---|
| ***A46B 17/06*** | (2006.01) |
| ***A47L 13/52*** | (2006.01) |
| ***A46B 5/00*** | (2006.01) |
| ***A47L 13/16*** | (2006.01) |
| ***A47L 13/256*** | (2006.01) |

(52) U.S. Cl.

CPC ..... *A47L 13/52* (2013.01); *A46B 5/0008* (2013.01); *A46B 17/06* (2013.01); *A47L 13/16* (2013.01); *A47L 13/256* (2013.01); *A46B 2200/302* (2013.01)

(58) Field of Classification Search

CPC ..... A46B 5/0008; A46B 17/06; A47L 13/52; Y10S 15/09

See application file for complete search history.

(56) References Cited

U.S. PATENT DOCUMENTS

| | | | | | |
|---|---|---|---|---|---|
| 883,752 | A * | 4/1908 | Spicer | A47L 13/502 | 15/142 |
| 1,788,844 | A * | 1/1931 | Powell | A47L 13/502 | 15/142 |
| 2,827,647 | A * | 3/1958 | Speer | B05C 17/10 | 15/105 |
| 2,880,438 | A * | 4/1959 | Lensing | A47L 13/58 | 15/142 |
| 4,494,267 | A * | 1/1985 | Fredley | A46B 17/06 | 15/1 |
| 5,802,657 | A | 9/1998 | Nogues et al. | | |
| 5,924,162 | A | 7/1999 | Kalscheur et al. | | |
| 6,119,303 | A * | 9/2000 | Passafiume | B44D 3/128 | 15/257.06 |
| 6,871,372 | B2 | 3/2005 | Vosbikian et al. | | |
| 7,584,518 | B1 | 9/2009 | Morad | | |

(Continued)

*Primary Examiner* — Randall Chin

(74) *Attorney, Agent, or Firm* — Mark C. Johnson; Johnson |Dalal

(57) ABSTRACT

A waste-receiving device is for use with a sweeping device. The waste-receiving device includes a body, and the body includes a chamber configured to receive waste therein. An opening is coupled to the chamber, and the opening permits the sweeping device to enter into the chamber. A panel is disposed within the chamber, and the panel includes a plurality of apertures. The panel is configured to engage the sweeping device and the plurality of apertures are configured to receive a cleaning component carried by the sweeping device to facilitate separating waste from the cleaning component.

19 Claims, 29 Drawing Sheets

(56) References Cited

U.S. PATENT DOCUMENTS

| | | | | |
|---|---|---|---|---|
| D646,434 | S | 10/2011 | Libman et al. | |
| 8,042,215 | B2 * | 10/2011 | Thibault | A47L 13/58 15/142 |
| 8,701,243 | B2 | 4/2014 | Ward et al. | |
| 8,719,990 | B2 | 5/2014 | Borofsky | |
| D720,911 | S | 1/2015 | Libman et al. | |
| 8,984,702 | B2 | 3/2015 | Pant | |
| 9,027,197 | B1 | 5/2015 | Gao | |
| 9,474,428 | B2 | 10/2016 | Sampaio | |
| 9,655,492 | B2 | 5/2017 | Schiavo et al. | |
| 2004/0016072 | A1 | 1/2004 | Libman et al. | |
| 2005/0071943 | A1 | 4/2005 | Liu | |
| 2007/0101529 | A1 | 5/2007 | Garcia | |
| 2008/0072388 | A1 | 3/2008 | Jones | |
| 2009/0019659 | A1 * | 1/2009 | Hill | B44D 3/123 15/257.06 |
| 2012/0180235 | A1 | 7/2012 | Libman et al. | |
| 2012/0195674 | A1 | 8/2012 | Mandle et al. | |
| 2014/0115813 | A1 | 5/2014 | Tussy | |
| 2014/0251373 | A1 | 9/2014 | Yan et al. | |

* cited by examiner

SWEEPING DEVICES, WASTE-RECEIVING DEVICES, AND METHODS OF USING THE SAME

CROSS-REFERENCE TO RELATED APPLICATION

The present application claims the benefit of and priority to, under 35 U.S.C. § 119(e), U.S. Provisional Application Ser. No. 62/413,484, filed Oct. 27, 2016, entitled MULTI-FUNCTIONAL SWEEPER, and U.S. Provisional Application Ser. No. 62/420,211, filed Nov. 10, 2016, entitled MULTI-FUNCTIONAL SWEEPER, which are hereby incorporated by reference in their entireties for all purposes.

TECHNICAL FIELD

The present disclosure generally relates to household sweeping and waste-receiving devices. More specifically, the present disclosure relates to microfiber dust mops and waste-receiving devices used with the same.

BACKGROUND

Traditional bristle brooms and dustpans are relatively effective for sweeping and disposing of relatively large debris on floor surfaces (that is, debris that is larger than dust, such as dirt, food particles, and the like). However, these bristle brooms are relatively ineffective for sweeping dust on floor surfaces. As a result, microfiber mops have been developed, which include, as the name implies, relatively small structures that facilitate capturing dust and other small particles. Unfortunately, however, cleaning the microfiber mops themselves can be relatively onerous and unsanitary. Specifically, to clean a microfiber mop a user may move outdoors and shake off the mop in the air, or stand over a waste receptacle and brush off the mop's microfiber component by hand, thereby increasing the likelihood of spreading airborne particles back into the environment. Or, a user may detach the microfiber component from the remainder mop and wash it in a washing machine, typically by itself to avoid contaminating other items. This action requires a relatively large amount of water for cleaning a single item.

SUMMARY

A waste-receiving device in accordance with an embodiment of the present disclosure is for use with a sweeping device. The waste-receiving device includes a body, and the body includes a chamber configured to receive waste therein. An opening is coupled to the chamber, and the opening permits the sweeping device to enter into the chamber. A panel is disposed within the chamber, and the panel includes a plurality of apertures. The panel is configured to engage the sweeping device and the plurality of apertures are configured to receive a cleaning component carried by the sweeping device to facilitate separating waste from the cleaning component.

A waste-receiving device in accordance with an embodiment of the present disclosure is for use with a sweeping device. The waste-receiving device includes a body, and the body includes a chamber configured to receive waste therein. An opening is coupled to the chamber, and the opening permits the sweeping device to enter into the chamber. A panel is disposed within the chamber, and the panel divides the chamber into a first waste-receiving portion and a second waste-receiving portion. The panel includes a plurality of cleaning elements. The panel is configured to engage the sweeping device and the plurality of cleaning elements are configured to engage a cleaning component carried by the sweeping device to facilitate separating waste from the cleaning component.

A method according to an embodiment of the present disclosure relates to using a waste-receiving device and a sweeping device. The waste-receiving device includes a body defining a chamber, and the waste-receiving device further includes a panel disposed within the chamber and dividing the chamber into a first waste-receiving portion and a second waste-receiving portion. The panel includes a plurality of cleaning elements, and the sweeping device includes a cleaning component. The method includes moving waste into the second waste-receiving portion of the chamber by moving the sweeping device relative to the waste-receiving device; positioning the cleaning component within the first waste-receiving portion of the chamber; and engaging the cleaning component with the plurality of cleaning elements of the panel and moving the cleaning component relative to the plurality of cleaning elements of the panel while the cleaning component is positioned within the first waste-receiving portion of the chamber to separate waste from the cleaning component.

While multiple embodiments are disclosed, still other embodiments of the present disclosure will become apparent to those skilled in the art from the following detailed description, which shows and describes illustrative embodiments of the disclosure. Accordingly, the drawings and detailed description are to be regarded as illustrative in nature and not restrictive.

It should be understood that the drawings are intended to facilitate understanding of exemplary embodiments of the present disclosure are not necessarily to scale.

DETAILED DESCRIPTION

Sweeping devices and waste-receiving devices according to some embodiments of the present disclosure facilitate conveniently disposing of both relatively small and relatively large waste particles, such as dust, earth, sand, food and the like. Waste-receiving devices according to some embodiments of the present disclosure include components that facilitate conveniently removing waste from sweeping devices. As such, sweeping devices and waste-receiving devices according to some embodiments of the present disclosure may be used instead of traditional bristle brooms, microfiber mops, dustpans, and/or vacuum cleaners.

Figure 1A:
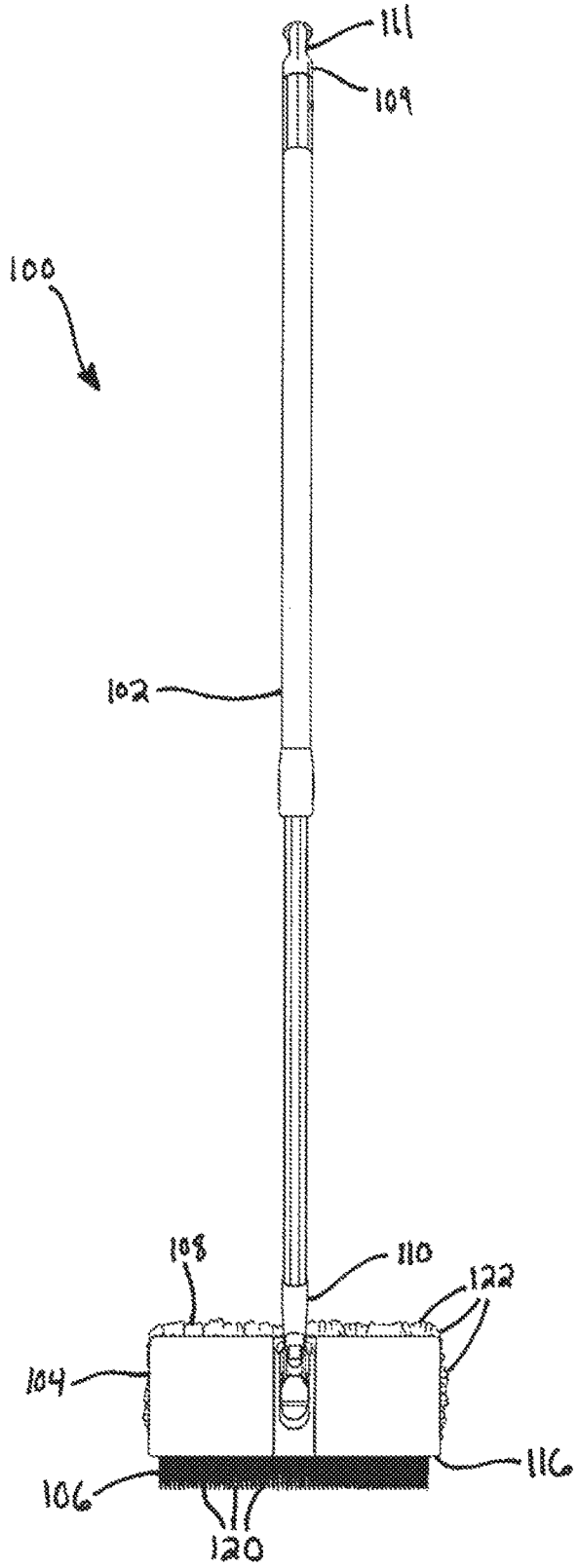
FIG. 1A is a front view of a sweeping device, according to an embodiment of the present disclosure.
Figure 1B:
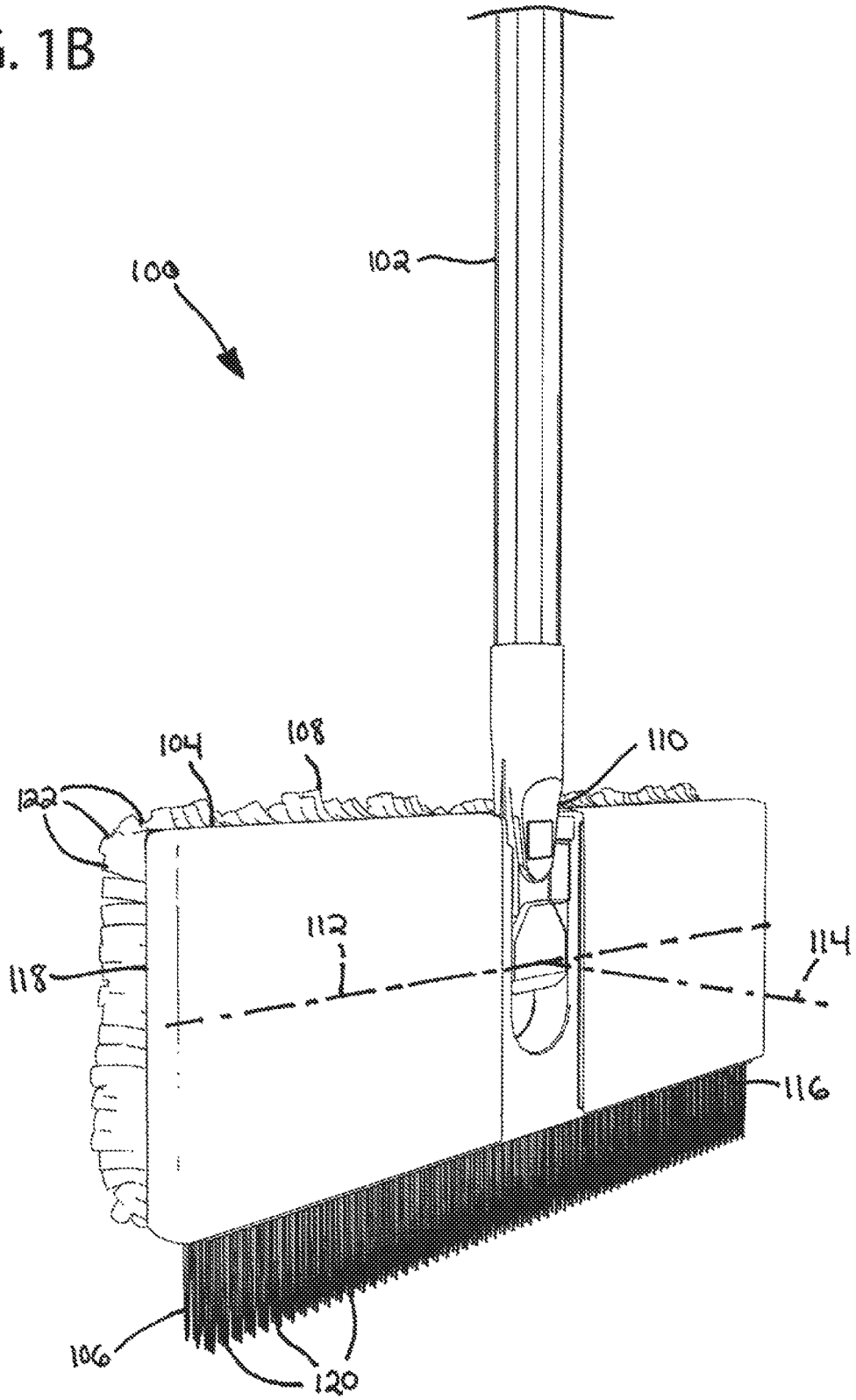
FIG. 1B is a partial front perspective view of the sweeping device of FIG. 1A.

FIGS. 1A and 1B illustrate a sweeping device 100, which may also be referred to as a broom, mop, or sweeper, according to an embodiment of the present disclosure. The sweeping device 100 generally includes a handle 102 that pivotably couples to a head 104, and the head 104 carries a first cleaning component 106 and a second cleaning component 108. These components and features are described in further detail below.

The handle 102 is an elongated component that may be grasped by a user during use of the sweeping device 100. The handle 102 may be formed of one or more materials, such as metals, polymers, and the like. The handle 102 is a selectively extendable, or telescoping, component. Stated another way, the length of the handle 102 may be selectively varied. In other embodiments, the handle 102 may be a non-extendable component.

The handle 102 includes an upper end 109 that is pivotable relative to the remainder of the handle 102. The upper end 109 may include an aperture 111 that facilitates hanging the sweeping device 100 from a hook, a nail, or the like.

Figure 1C:
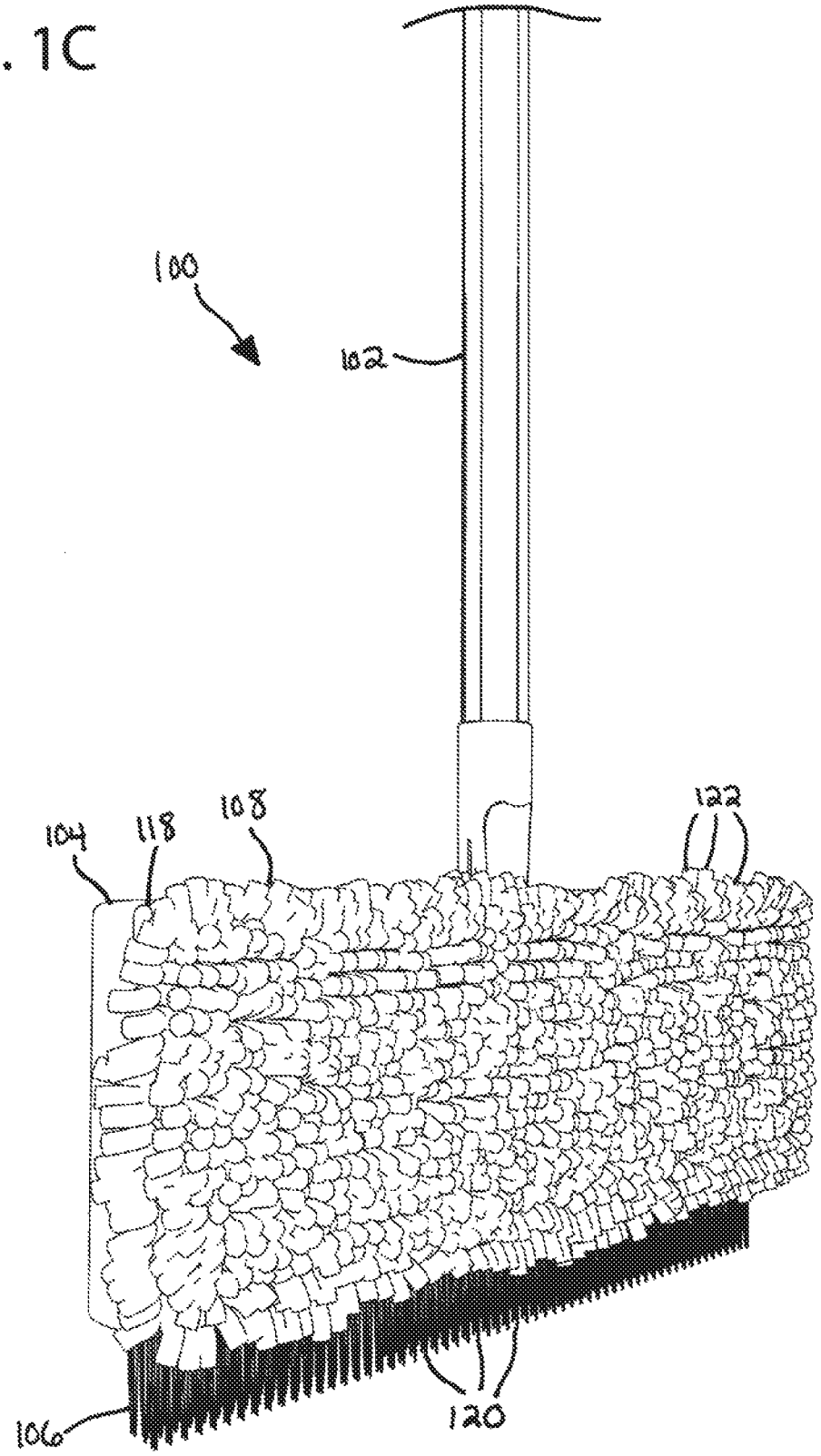
FIG. 1C is a partial rear perspective view of the sweeping device of FIG. 1A.

One end of the handle 102 couples to a joint 110, which in turn couples to the head 104. The joint 110 permits pivoting of the head 104, relative to the handle 102, about two perpendicular axes 112 and 114 (see FIG. 1B). Stated another way, the joint 110 is a two degree-of-freedom pivoting joint. In some embodiments, one or both of the joint 110 and the head 104 may include features or carry components (not shown) that facilitate selectively securing the head 104 relative to the handle 102 in the configuration shown in FIGS. 1A-1C. Such features or components include, for example, magnetic components, press-fittingly coupled surfaces, or the like. In other embodiments, the head 104 is not selectively securable to the handle 102.

The head 104 may be formed of one or more materials, such as metals, polymers, and the like. The head 104 includes a generally rectangular three-dimensional shape. In other embodiments, the head 104 may include other general shapes, such as a trapezoidal three-dimensional shape, an oval three-dimensional shape, or the like. In some embodiments and as shown in the drawings, the head 104 includes a first surface 116, more specifically, an end surface, that carries the first cleaning component 106. The head 104 also includes a second surface 118, more specifically, an adjacent lower surface, that carries the second cleaning component 108. The first cleaning component 106 is a plurality of bristles 120 formed of one or more of fibrous materials, polymers, or the like. As such, the first cleaning component 106 is configured to move relatively large waste particles, such as dust, earth, sand, food and the like, when engaged with a floor surface and moved thereacross. The second cleaning component 108 includes a plurality of flexible arms 122, which may also be referred to as "tentacles", formed from a microfiber material. As such, the second cleaning component 108 is configured to move relatively small waste particles, dust, earth, sand, food and the like, when engaged with a floor surface and moved thereacross. The first cleaning component 106 and the second cleaning component 108 are detachably carried by the head 104. In other embodiments, the first cleaning component 106 and/or the second cleaning component 108 are non-detachably carried by the head 104. In some embodiments, the first cleaning component 106 and/or the second cleaning component 108 may take other forms or may be formed of other materials. As a specific example, the first cleaning component 106 and/or the second cleaning component 108 may be disposable wet cloths, disposable dry cloths, or the like. In some embodiments, only one surface of the head 104 may couple to a cleaning component, or three or more surfaces of the head 104 may each couple to cleaning components.

Figure 2:
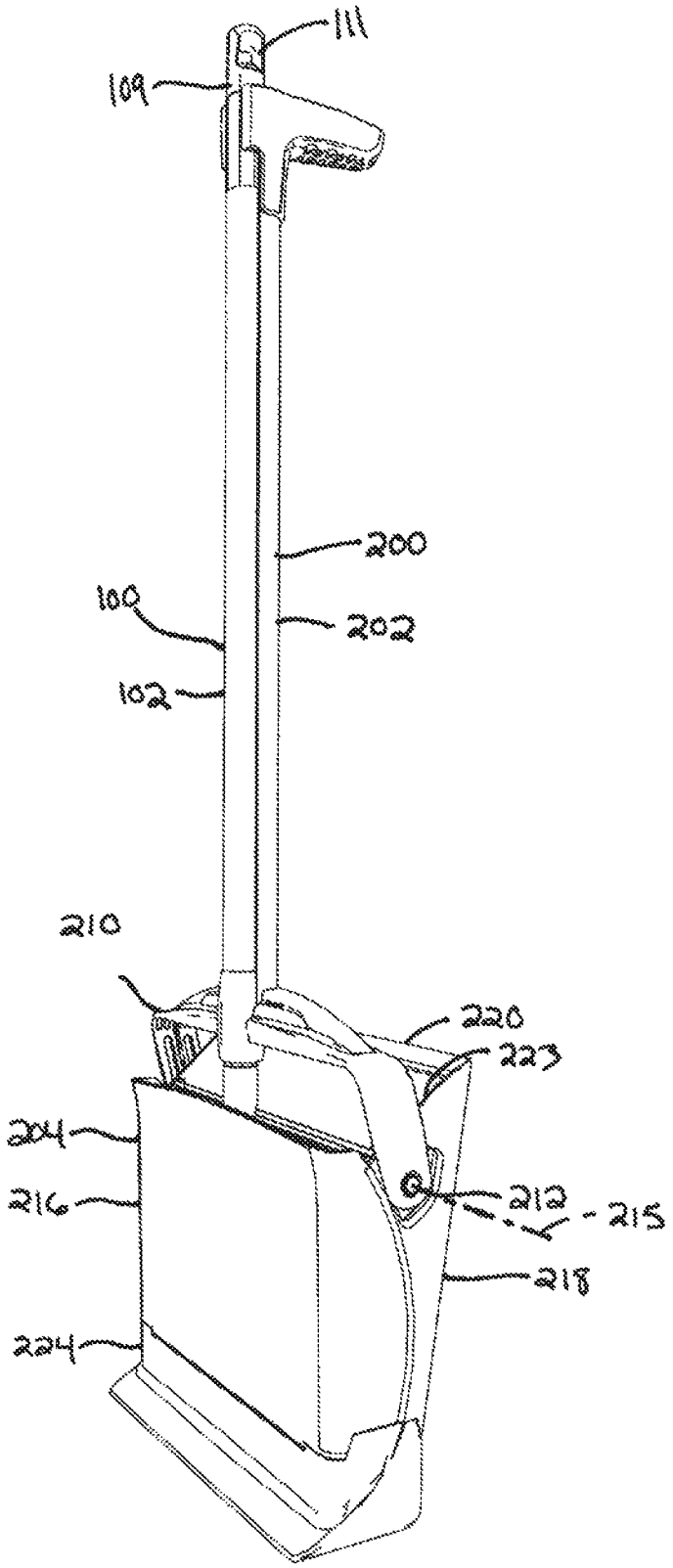
FIG. 2 is a front perspective view of a waste-receiving device, according to an embodiment of the present disclosure, receiving the sweeping device of FIG. 1A.
Figure 3A:
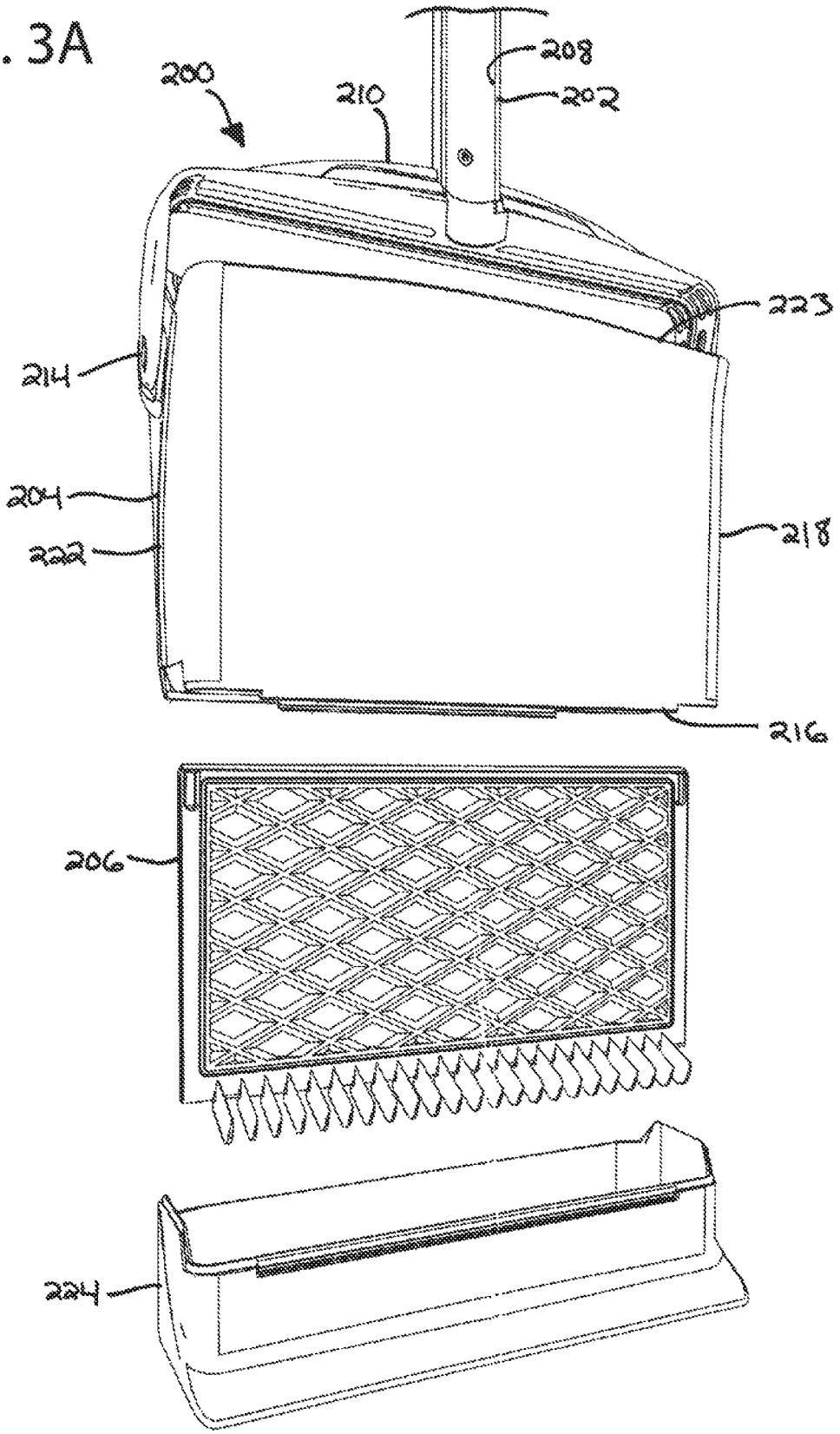
FIG. 3A is an exploded front perspective view of the waste-receiving device of FIG. 2.
Figure 3B:
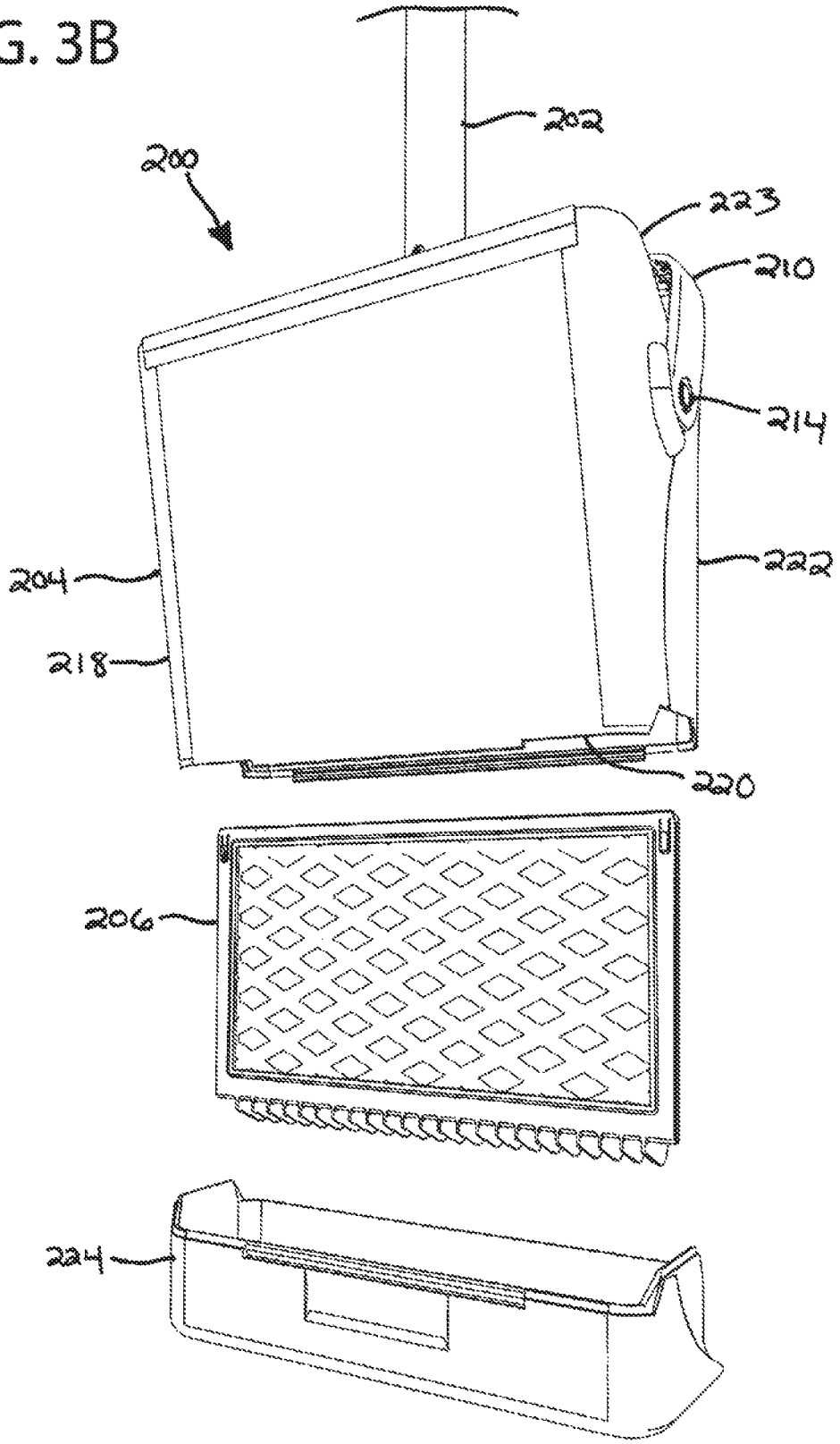
FIG. 3B is an exploded rear perspective view of the waste-receiving device of FIG. 2.
Figure 4:
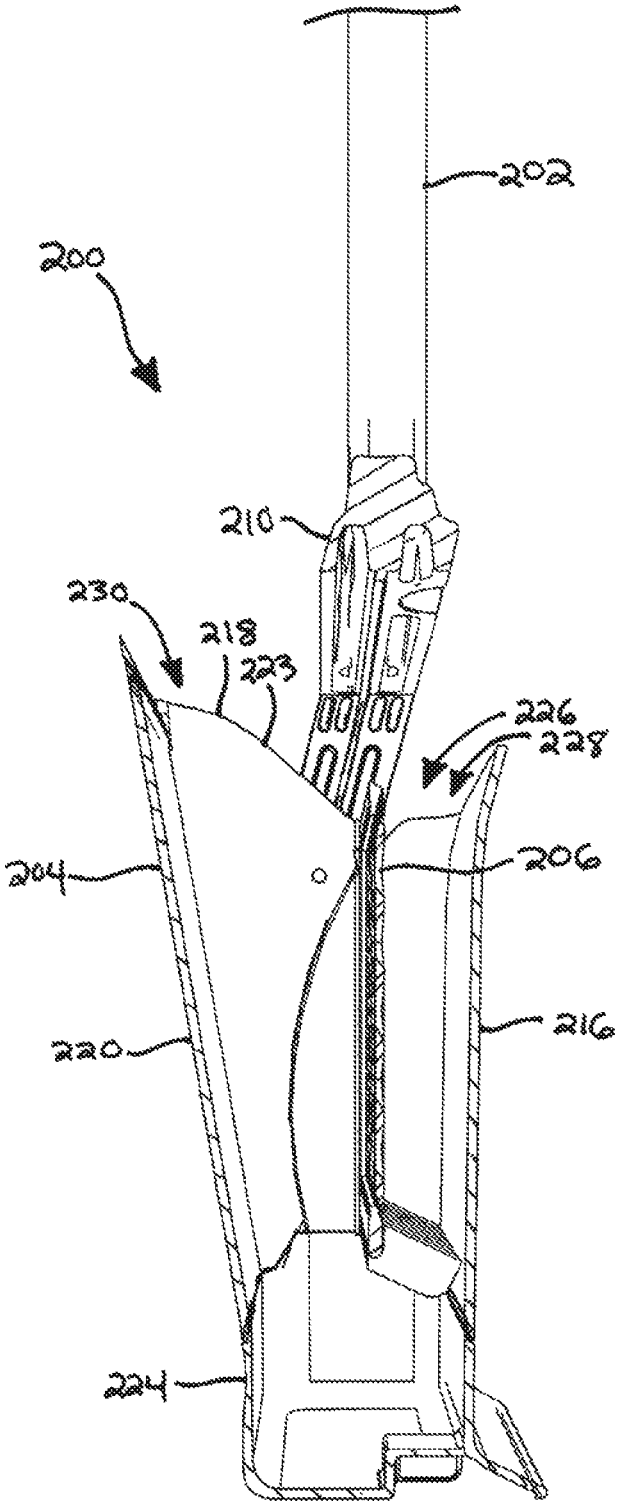
FIG. 4 is a side sectional perspective view of the waste-receiving device of FIG. 2; the section plane bisects the waste-receiving device.

FIGS. 2-4 illustrate a waste-receiving device 200, which may also be referred to as a dustpan, dust bin, dust collector, waste bin, or waste collector, according to an embodiment of the present disclosure. FIG. 2 also illustrates the waste-receiving device 200 receiving the sweeping device 100. The waste-receiving device 200 generally includes a handle 202 that pivotably couples to a body 204, which may also be referred to as a container, and the body 204 houses a panel 206 that facilitates cleaning the cleaning components carried by the head 104 of the sweeping device 100. These components and features are described in further detail below.

The handle 202 is an elongated component that may be grasped by a user during use of the waste-receiving device 200. The handle 202 may be formed of one or more materials, such as metals, polymers, and the like. The handle 202 includes a concave surface 208 (see FIG. 3A) extending along its length to facilitate selectively receiving the handle 102 of the sweeping device 100 (see FIG. 2; for example, for storage of the sweeping device 100 and the waste-receiving device 200 when not desired for immediate or long-term use). The handle 202 includes a U-shaped frame 210 that couples to joints 212 and 214 at ends thereof, and the joints 212 and 214 in turn couple to the body 204. The joints 212 and 214 permit pivoting of the body 204, relative to the handle 202, about a transverse axis 215 (see FIG. 2). Stated another way, the joints 212 and 214 are one degree-of-freedom pivoting joints.

The body 204 may be formed of one or more materials, such as metals, polymers, and the like. The body 204 generally includes sidewalls 216, 218, 220, and 222 and a detachable base 224 that define a waste-receiving chamber 226 (see FIG. 4). The sidewalls 216, 218, 220, and 222 define an opening 223 coupled to the chamber 226. The opening 223 and the chamber 226 are sized such that the head 104 of the sweeping device 100 may enter into the chamber 226 via the opening 223. This aspect is described in further detail below.

In some embodiments, one or more of the sidewalls 216, 218, 220, and 222 may include a plurality of cleaning elements (not shown) at the opening 223. Such cleaning elements may point inwardly toward the chamber 226 and facilitate cleaning the first cleaning component 106 of the sweeping device 100 when the head 104 of the sweeping device 100 exits the chamber 226. Such cleaning elements may be teeth or the like.

Referring specifically to FIG. 4, the panel 206 is disposed within the chamber 226 of the body 204. The panel 206 is generally disposed in plane that is parallel to the transverse axis 215 and perpendicular to the opening 223 of the body 204. In other embodiments, the panel 206 may be disposed in other orientations relative to features of the body 204. In some embodiments and as shown in the drawings, the panel 206 is detachably coupled to the body 204 to facilitate, for example, removing the panel 206 from the body 204 and washing the panel 206 to remove waste. In other embodiments, the panel 206 is non-detachably coupled to the body 204. In some embodiments and as shown in the drawings, the panel 206 is disposed such that it divides the chamber 226 into a first waste-receiving portion 228 on a first side of the panel 206 and a second waste-receiving portion 230 on a second side of the panel 206.

Figure 5A:
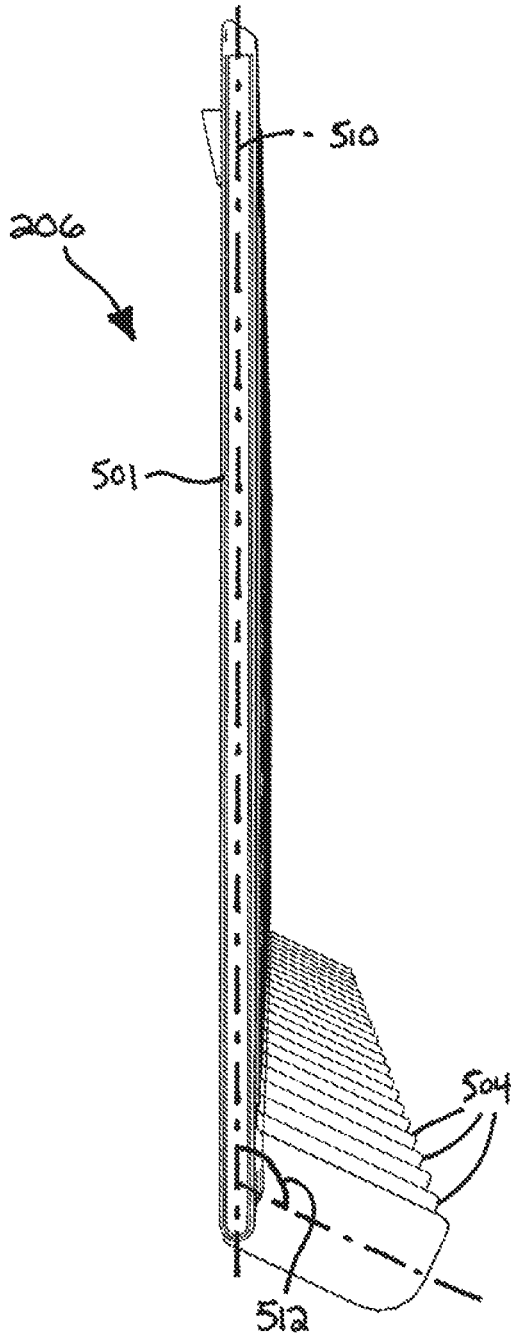
FIG. 5A is a side perspective view of a panel, according to an embodiment of the present disclosure, of the waste-receiving device of FIG. 2.
Figure 5B:
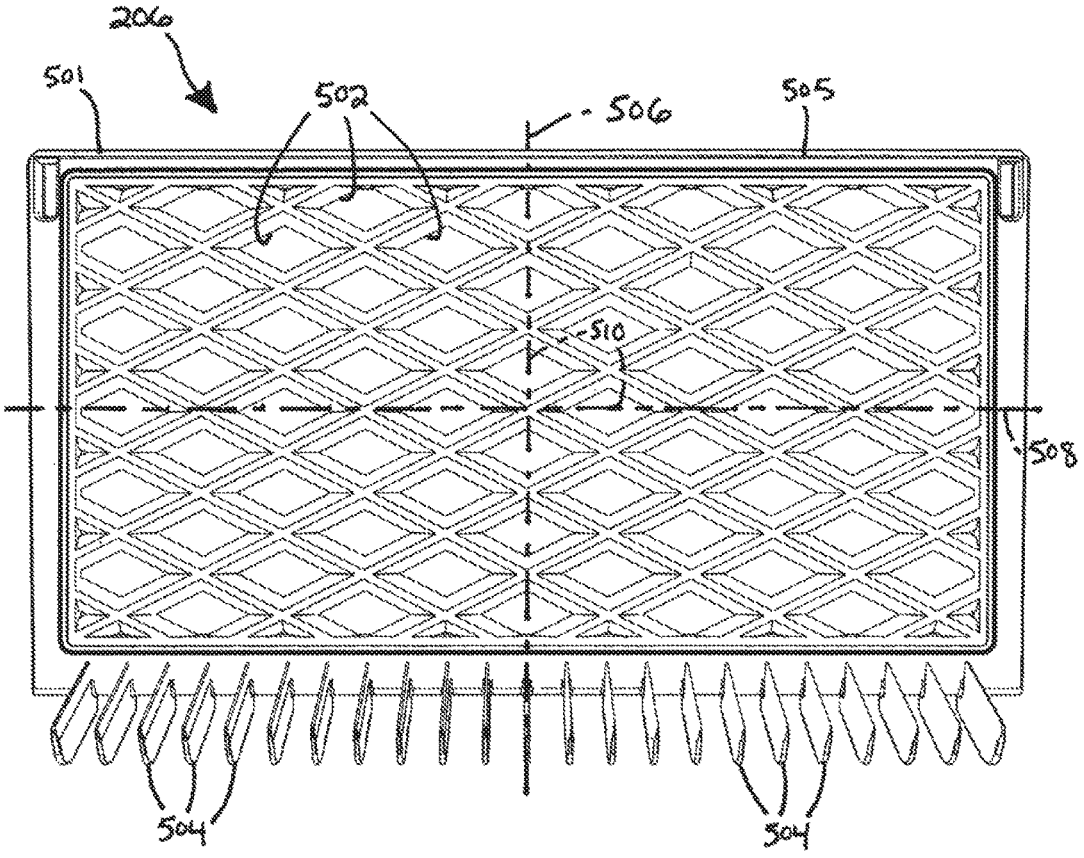
FIG. 5B is a front perspective view of the panel of FIG. 5A.
Figure 5C:
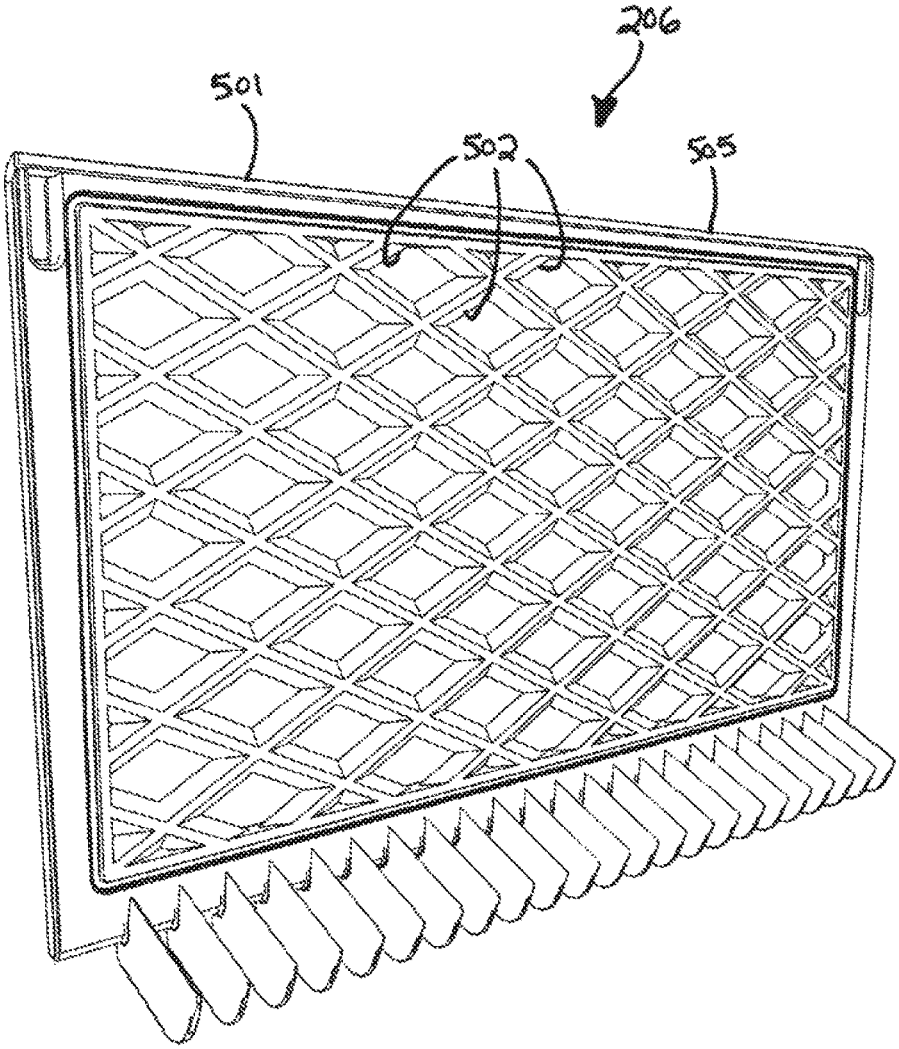
FIG. 5C is another front perspective view of the panel of FIG. 5A.

FIGS. 5A-5C illustrate the panel 206 separately from the other components of the waste-receiving device 200. The panel 206 generally includes a rectangular shape. In other embodiments, the panel 206 generally includes a different shape, such as a trapezoidal shape, an oval shape, or the like. In some embodiments and as shown in the drawings, the panel 206 has a similar general shape to that of the head 104 of the sweeping device 100. In other embodiments, the panel 206 has a different general shape to that of the head 104 of the sweeping device 100.

The panel 206 includes a perimeter 501 and a plurality of cleaning elements coupled to the perimeter 501. The plurality of cleaning elements are configured to engage the cleaning components of the head 104 of the sweeping device 100 to clean (that is, separate waste from) the cleaning components when the head 104 is disposed within the chamber 226. In some embodiments and as shown in the drawings, the cleaning elements include a plurality of apertures 502 that extend through the panel 206 and a plurality of teeth 504 disposed at an edge of the panel 206. When the panel 206 is disposed within the chamber 226, the apertures 502 are disposed between the teeth 504 and the opening 223.

The apertures 502 are configured to receive the flexible arms 122 of the second cleaning component 108 when the head 104 is disposed within the chamber 226 (specifically, the first waste-receiving portion 228 of the chamber 226). The head 104 may be moved back and forth relative to the panel 206 to cause flexible arms 122 to exit and enter the apertures 502, thereby cleaning the flexible arms 122. In some embodiments and as shown in the drawings, the apertures 502 each have a diamond shape. The apertures 502 may each have a height (that is, a dimension in a longitudinal direction 506, or the vertical direction in FIG. 5B) in a range of 0.5 inches to 1.0 inches. The apertures 502 may each have a width (that is, a dimension in a transverse direction 508, or the horizontal direction in FIG. 5B) in a range of 1.0 inches to 1.5 inches. In some embodiments and as shown in the drawings, the apertures 502 each have beveled edges. In some embodiments and as shown in the drawings, the apertures 502 are arranged in a pattern.

The apertures 502 may take various other forms. For example, the apertures 502 may each have a different shape, such as a rectangular shape, a circular shape, an oval shape, a triangular shape, or the like. As another example, one or more of the apertures 502 may have different shapes than one or more other apertures 502. As another example, one or more of the apertures 502 may have different dimensions than one or more other apertures 502. As another example, one or more of the apertures 502 may have non-beveled edges. As yet another example, one or more of the apertures 502 may be arranged randomly relative other apertures 502 (that is, not arranged in a pattern).

In some embodiments, the cleaning elements may include a plurality of protrusions (not shown) in addition to or in lieu of the plurality of apertures 502. Such protrusions may be disposed in the first waste-receiving portion 228.

The teeth 504 are configured to engage the bristles 120 of the first cleaning component 106 when the head 104 is disposed within the chamber 226 (specifically, the first waste-receiving portion 228 of the chamber 226). As such, back and forth movement of the head 104 relative to the panel 206 (to facilitate cleaning the flexible arms 122 via the apertures 502, as described above) also causes the bristles 120 to engage the teeth 504, thereby cleaning the bristles 120. In some embodiments and as shown in the drawings, the teeth 504 each have a generally rectangular shape as viewed in the transverse direction 508 (that is, as shown in FIG. 5A). In some embodiments and as shown in the drawings, the teeth 504 each have a width (in the transverse direction 508) in a range of 0.0625 inches to 0.125 inches. In some embodiments and as shown in the drawings, the teeth 504 may be disposed apart in the transverse direction 508 by a distance in a range of 0.25 inches to 0.625 inches. In some embodiments and as shown in the drawings, the teeth 504 extend from a plane 510 of the remainder of the panel 206 (in which the longitudinal and transverse directions 506 and 508 are disposed) at an obtuse angle 512. The obtuse angle 512 may be in a range of 100 degrees to 130 degrees.

The teeth 504 may take various other forms. For example, the teeth 504 may each have a different shape, such as a generally circular shape, a generally oval shape, a generally triangular shape, or the like. As another example, one or more of the teeth 504 may have a different shape than one or more other teeth 504. As another example, one or more of the teeth 504 may have a different thickness than one or more other teeth 504. As another example, one or more of the teeth 504 may be disposed apart in the transverse direction by a different distance than other teeth 504. As another example, the teeth 504 may each extend from the plane at a non-obtuse angle. As yet another example, one or more of the teeth 504 may extend from the plane at a different angle than one or more other teeth 504.

In some embodiments, other portions of the panel 206 could include cleaning elements. For example and as described in further detail below, an upper edge 505 of the panel 206 could include cleaning elements. Such cleaning elements may facilitate cleaning the first cleaning component 106 and the second cleaning component 108 when the head 104 of the sweeping device 100 enters the chamber 226. Such cleaning elements may be teeth or the like.

Figure 6A:
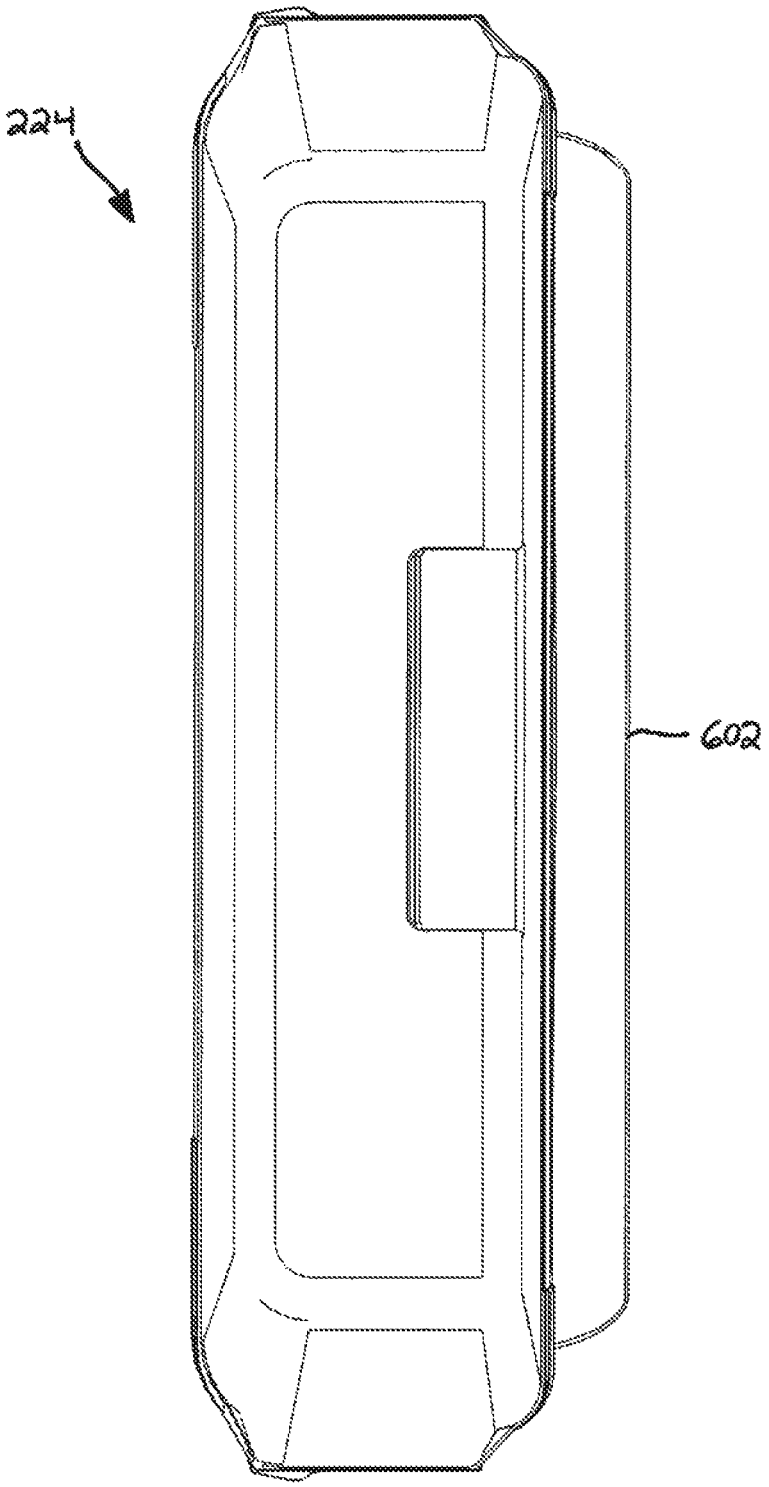
FIG. 6A is a top perspective view of a detachable base, according to an embodiment of the present disclosure, of the waste-receiving device of FIG. 2.
Figure 6B:
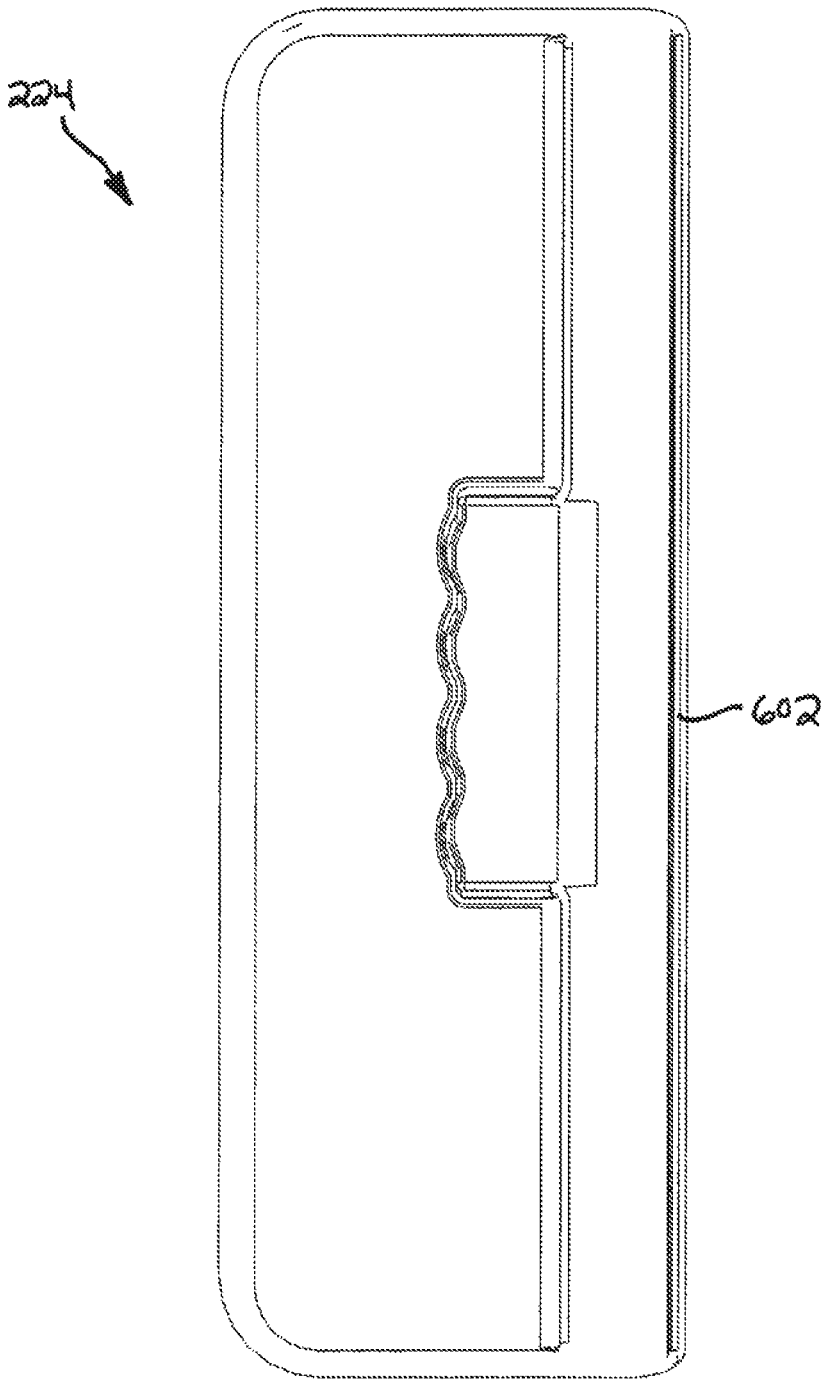
FIG. 6B is a bottom perspective view of the detachable base of FIG. 6A.

FIGS. 6A and 6B illustrate the detachable base 224 separately from the other components of the waste-receiving device 200. The base 224 may be detached from the remainder of the body 204, for example, to dispose of waste accumulated within the chamber 226. The base 224 includes a leg 602 that is configured to engage the floor surface and facilitate standing the waste-receiving device 200 and, optionally, the sweeping device 100, in the orientations shown in FIGS. 2-4. In some embodiments, body 204 lacks a detachable base 224, and the base 224 is monolithically formed with the side walls.

Figure 7A:
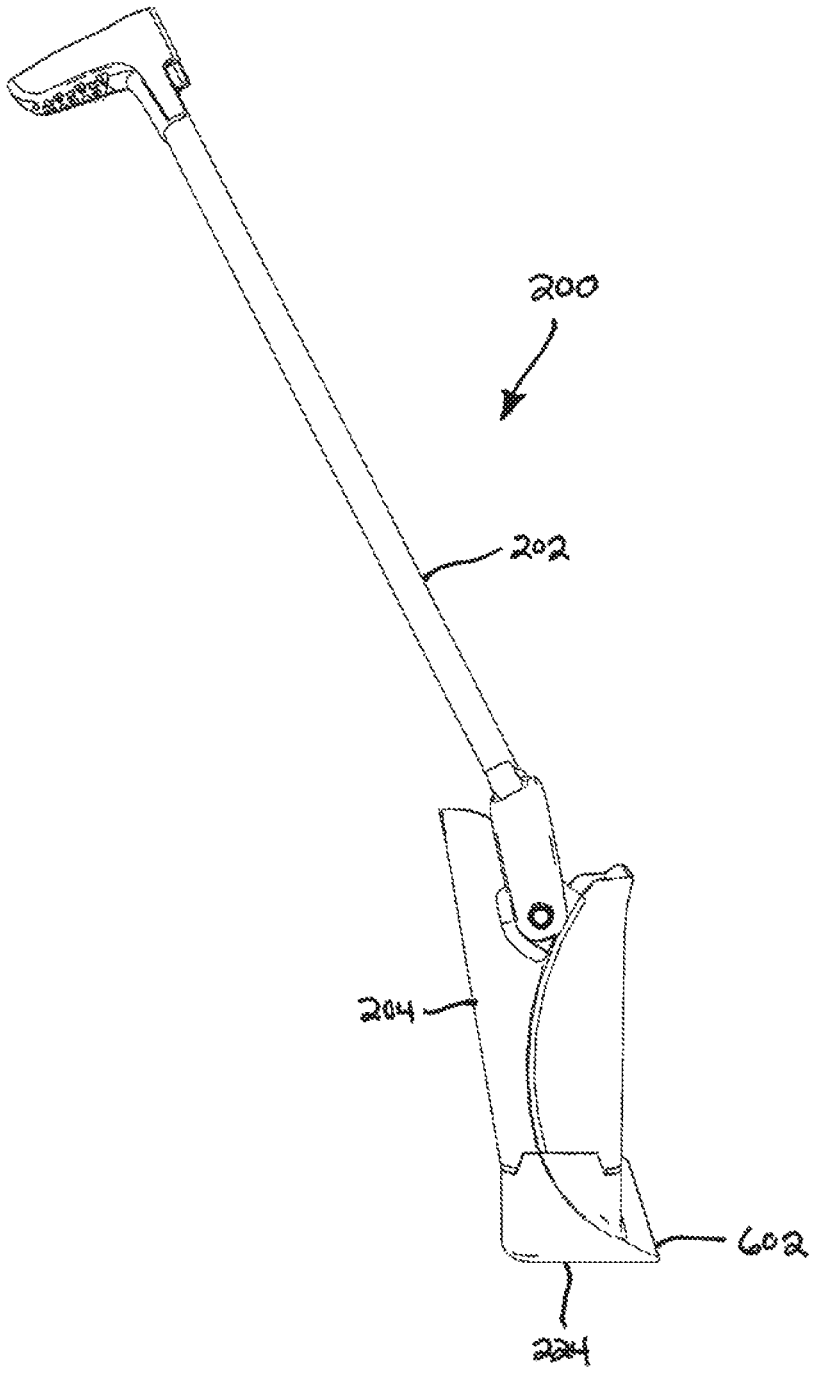
FIG. 7A is a side perspective view of the waste-receiving device of FIG. 2 in a first orientation.
Figure 7B:
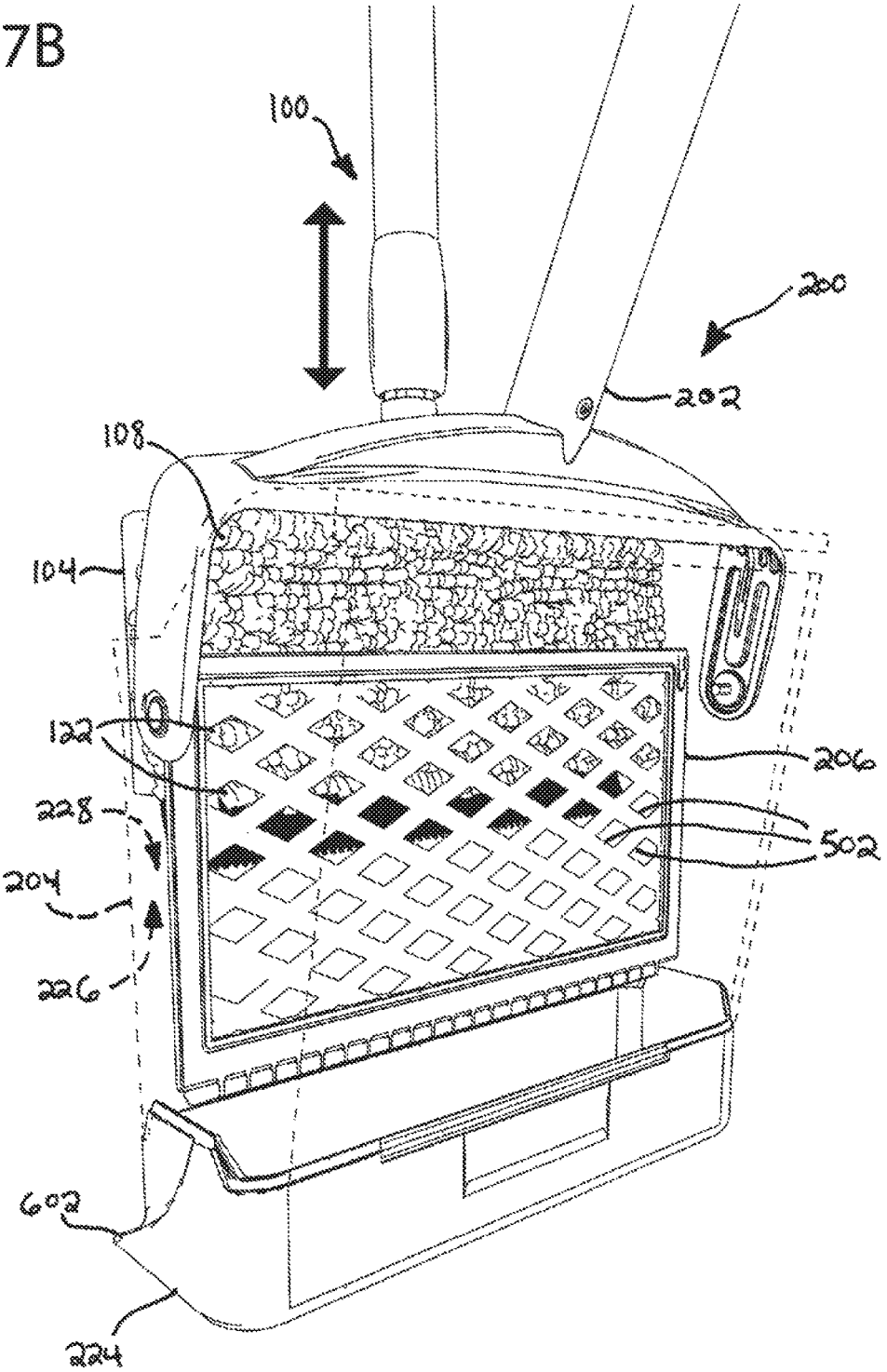
FIG. 7B is a partial rear perspective view of the waste-receiving device of FIG. 2 in the first orientation and receiving the sweeping device of FIG. 1A.

The sweeping device 100 and the waste-receiving device 200 may be used in various orientations relative to each other and floor surfaces. For example, FIGS. 7A and 7B illustrate the waste-receiving device 200 in a first orientation, or a standing orientation, in which the waste-receiving device 200 may be used. FIG. 7B also illustrates the waste-receiving device 200 receiving the sweeping device 100 (the body 204 of the waste-receiving device 200 is shown with hidden lines for clarity). In the first orientation, the base 224 of the body 204 (specifically the leg 602 of the base 224) engages the floor surface, and the remainder of the body 204 and the handle 202 are disposed thereabove. The head 104 of the sweeping device 100 is positioned in the chamber 226 of the body 204 (specifically, the first waste-receiving portion 228 of the chamber 226) such that the flexible arms 122 of the second cleaning component 108 are received in the apertures 502 of the panel 206. The head 104 of the sweeping device 100 is moved back and forth, or up and down, relative to the panel 206 to clean (that is, separate waste from) the flexible arms 122.

Figure 8A:
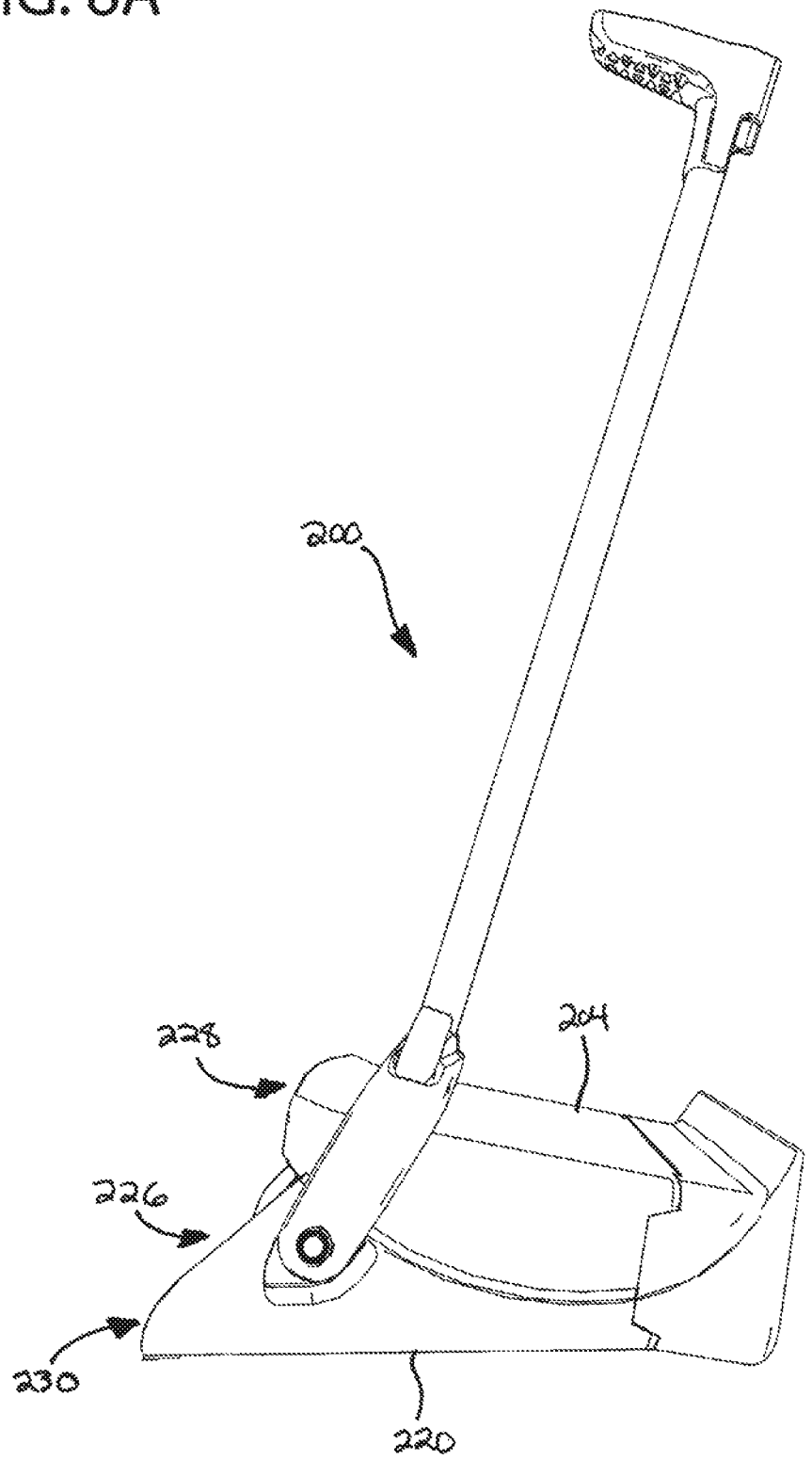
FIG. 8A is a side perspective view of the waste-receiving device of FIG. 2 in a second orientation.
Figure 8B:
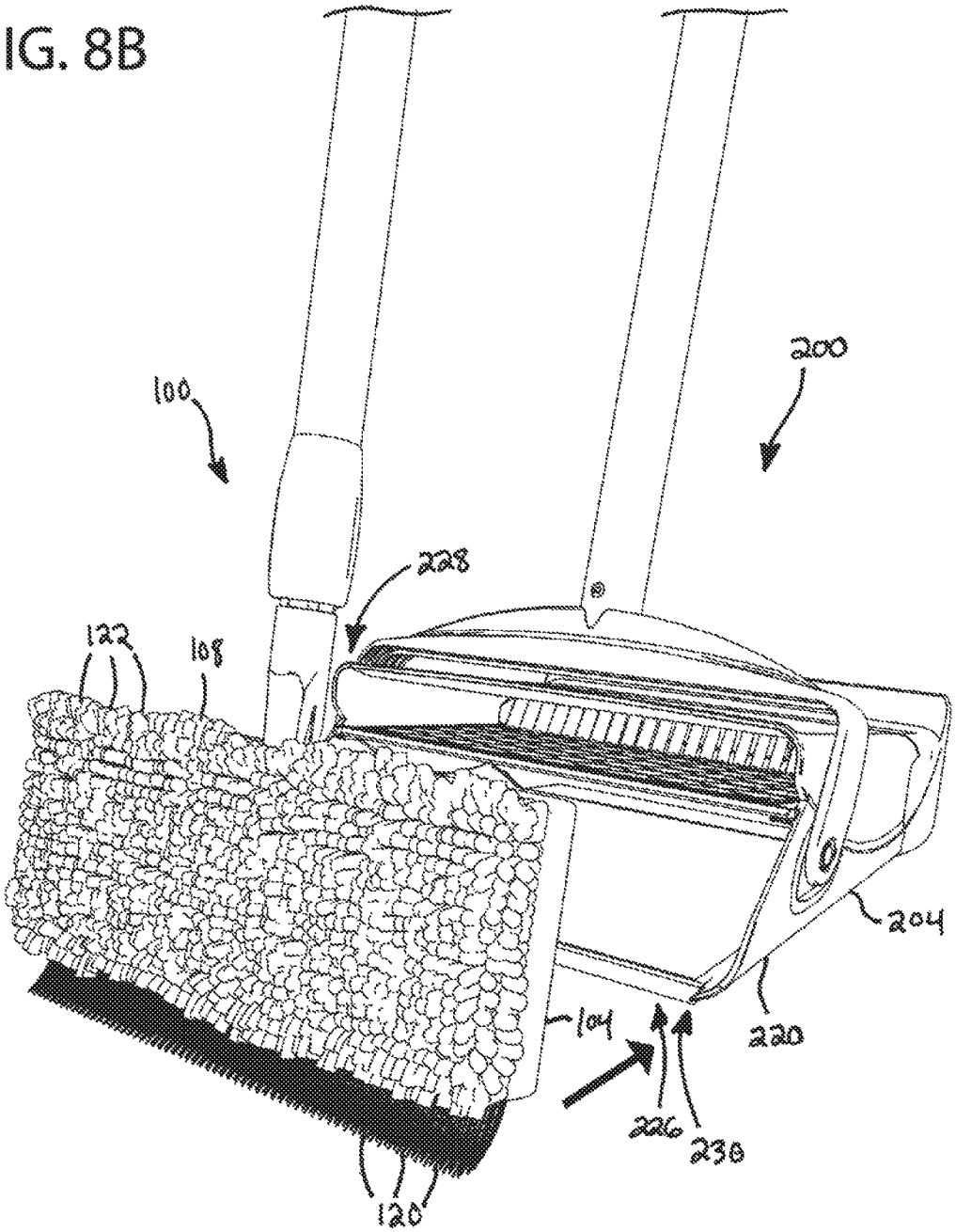
FIG. 8B is a partial front perspective view of the waste-receiving device of FIG. 2 in the second orientation and the sweeping device of FIG. 1A moving waste into the waste-receiving device.
Figure 8C:
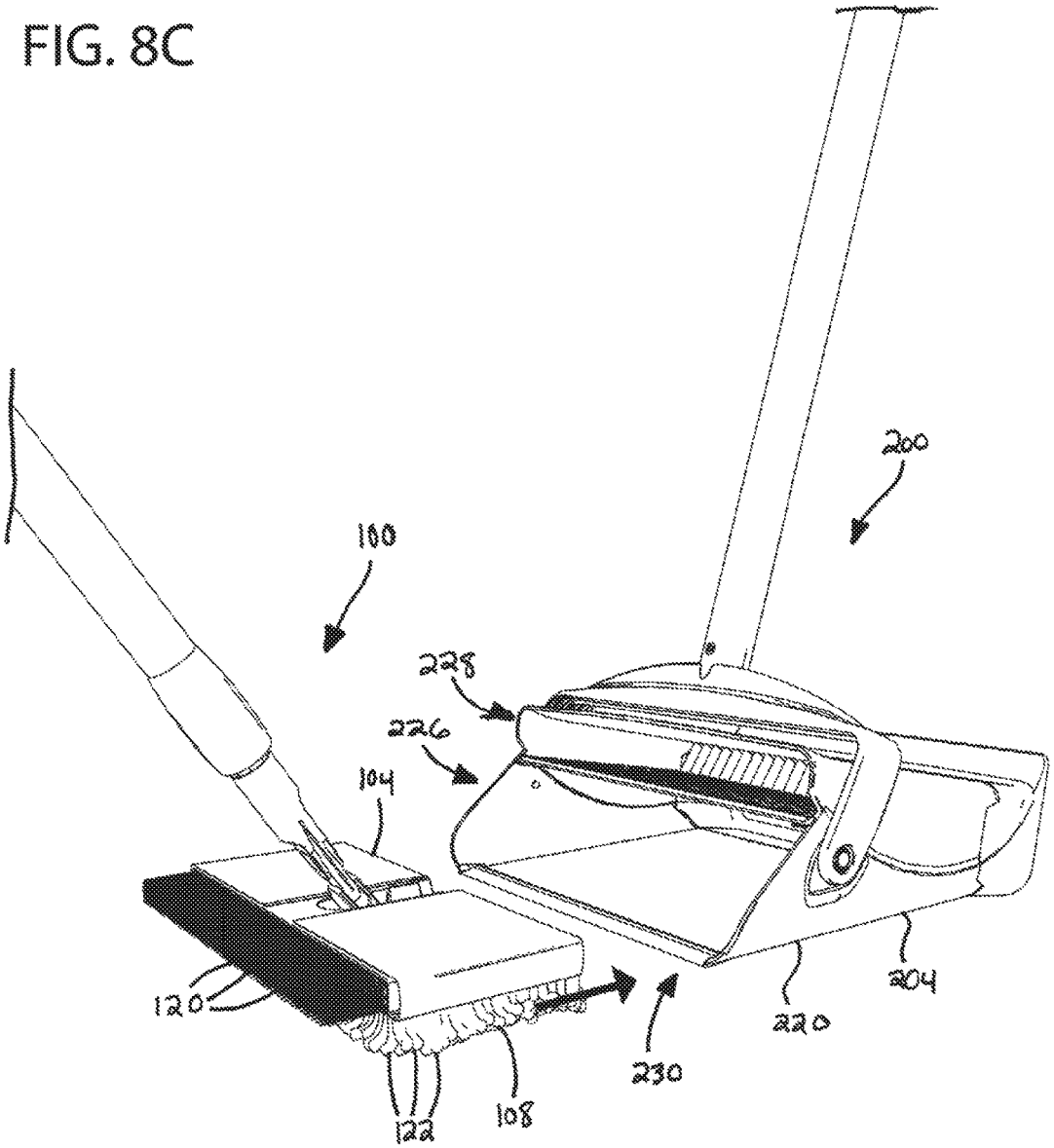
FIG. 8C is another partial front perspective view of the waste-receiving device of FIG. 2 in the second orientation and the sweeping device of FIG. 1A moving waste into the waste-receiving device.

FIGS. 8A-8C illustrate the waste-receiving device 200 in a second orientation, or a seated orientation, in which the waste-receiving device 200 may be used. FIGS. 8B and 8C also illustrate the sweeping device 100 moving waste into the waste-receiving device 200. In the second orientation, the sidewall 220 of the body 204 adjacent to the second waste-receiving portion 230 and opposite the first waste-receiving portion 228 engages the floor surface. As such, the second waste-receiving portion 230 is disposed adjacent to the ground, and the first waste-receiving portion 228 is disposed thereabove. In some embodiments and as shown in the drawings, the second orientation may be substantially 90 degrees from the first orientation (that is, 90 degrees±5 degrees). As shown specifically in FIG. 8B, the head 104 of the sweeping device 100 may be oriented such that the bristles 120 engage the floor surface, and the sweeping device 100 may then be moved relative to the waste-receiving device 200 to move waste, via the bristles 120, toward and into the chamber 226 (specifically, the second waste-receiving portion 230 of the chamber 226). As shown specifically in FIG. 8C, the head 104 of the sweeping device 100 may also be oriented such that the flexible arms 122 of the second cleaning component 108 engage the floor surface, and the sweeping device 100 may then be moved relative to the waste-receiving device 200 to move waste, via the flexible, toward and into the chamber 226 (specifically, the second waste-receiving portion 230 of the chamber 226) and to collect waste on the flexible arms 122.

FIGS. 9A-9E illustrate a waste-receiving device 900, which may also be referred to as a dustpan, dust bin, dust collector, waste bin, or waste collector, according to another embodiment of the present disclosure. The waste-receiving device 900 generally includes a body 902, which may also be referred to as a container, and the body 902 houses a panel 904 that facilitates cleaning a sweeping device. These components and features are described in further detail below.

The body 902 may be formed of one or more materials, such as metals, polymers, and the like. The body 902 generally includes sidewalls 906, 908, 910, and 912 and a base wall 914 that together define a waste-receiving chamber 916. The sidewalls 906, 908, 910, and 912 define an opening 918 coupled to the chamber 916. The opening 918 and the chamber 916 are sized such that the head of a sweeping device may enter into the chamber 916 via the opening 918. The upper sidewall 906 may include a cut-out portion 920 and/or couple to one or more generally L-shaped brackets 922 to facilitate engaging the head of a sweeping device. These aspects are described in further detail below.

In some embodiments, one or more of the sidewalls 906, 908, 910, and 912 and or the base wall 914 may couple to one or more high-friction pads 924 that inhibit the waste-receiving device 900 from sliding across floor surfaces. More specifically and as shown in the drawings, the lower sidewall 910 and the base wall 914 may each couple to two high-friction pads 924. In some embodiments, one or more pads could couple to both the lower sidewall 910 and the base wall 914 (that is, wrap around a corner of the body 902).

In some embodiments and as shown in the drawings, the lower sidewall 910 may couple to a guide ramp 926, also referred to as a "seal," disposed at the opening 918 of the chamber 916. The guide ramp 926 directs a sweeping device toward the panel 904 and into an appropriate position within the chamber 916. These aspects are described in further detail below.

Figure 9A:
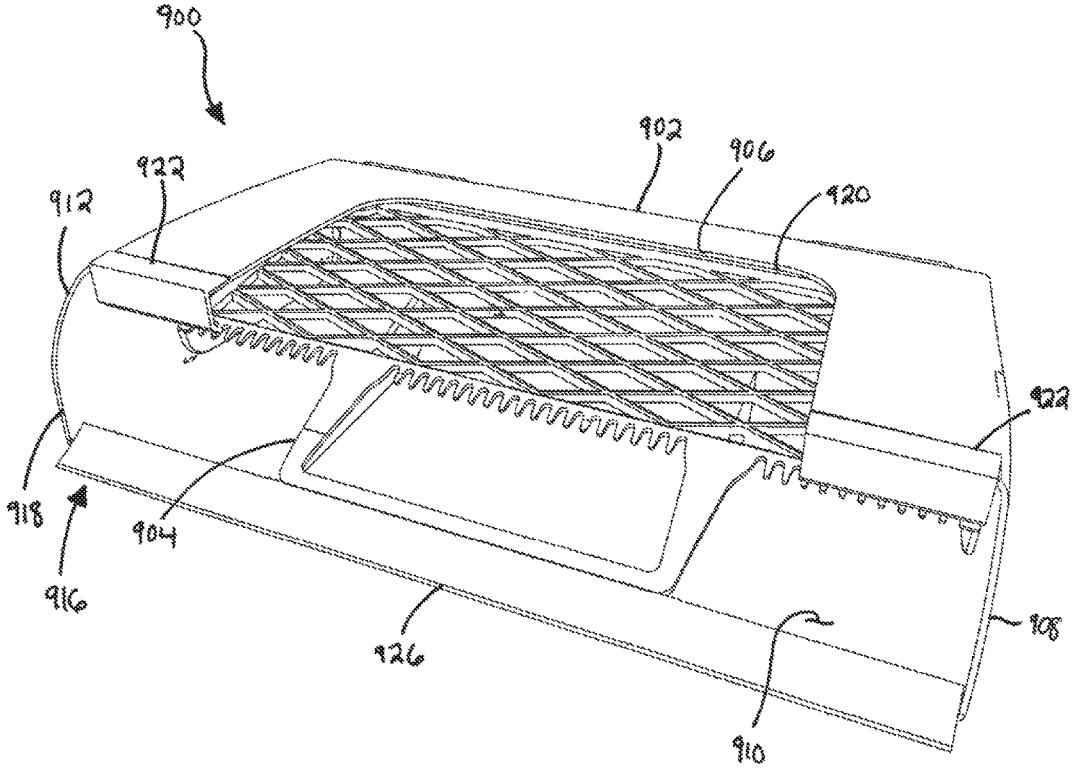
FIG. 9A is a front perspective view of a waste-receiving device, according to another embodiment of the present disclosure.
Figure 9B:
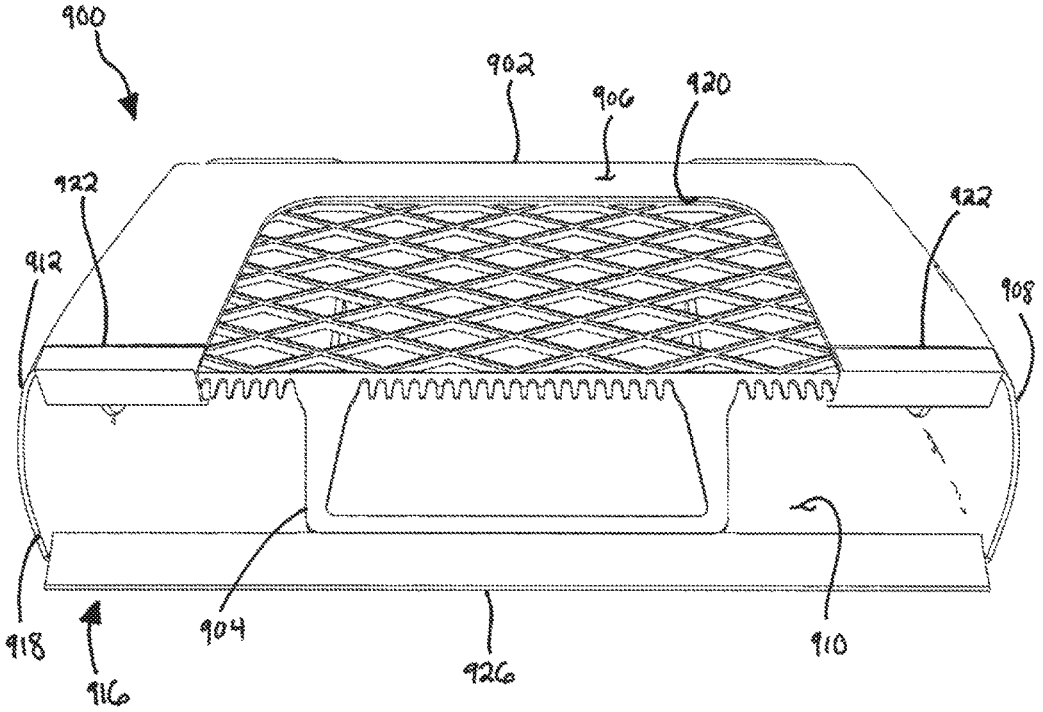
FIG. 9B is another front perspective view of the waste-receiving device of FIG. 9A.
Figure 9C:
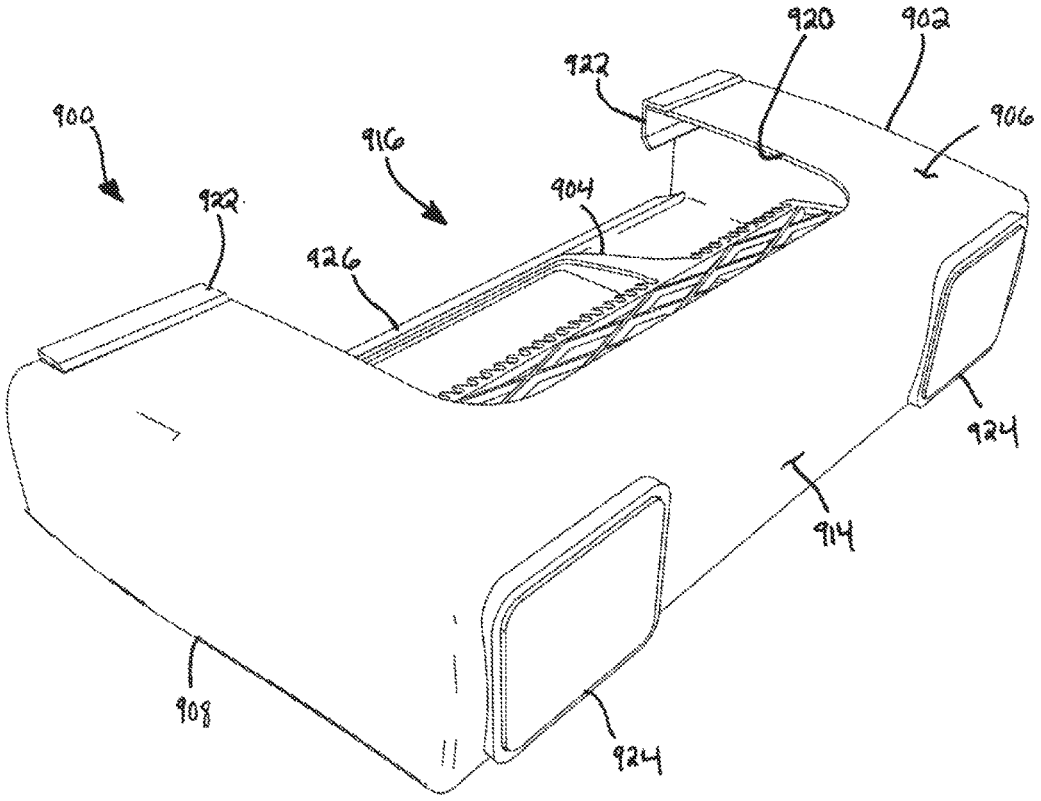
FIG. 9C is a rear perspective view of the waste-receiving device of FIG. 9A.
Figure 9D:
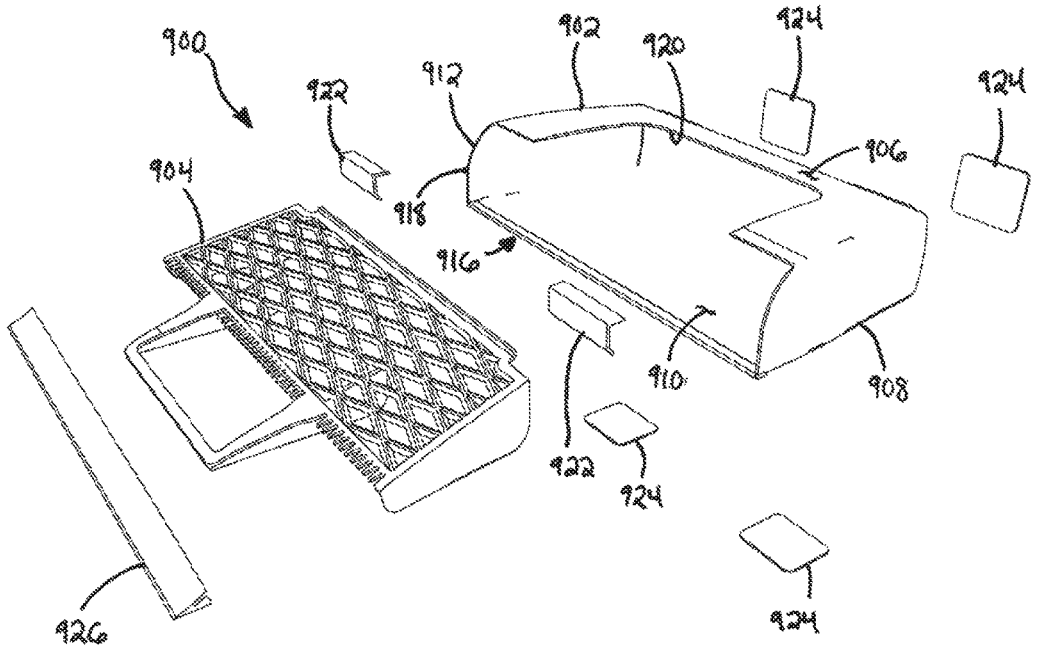
FIG. 9D is an exploded front perspective view of the waste-receiving device of FIG. 9A.
Figure 9E:
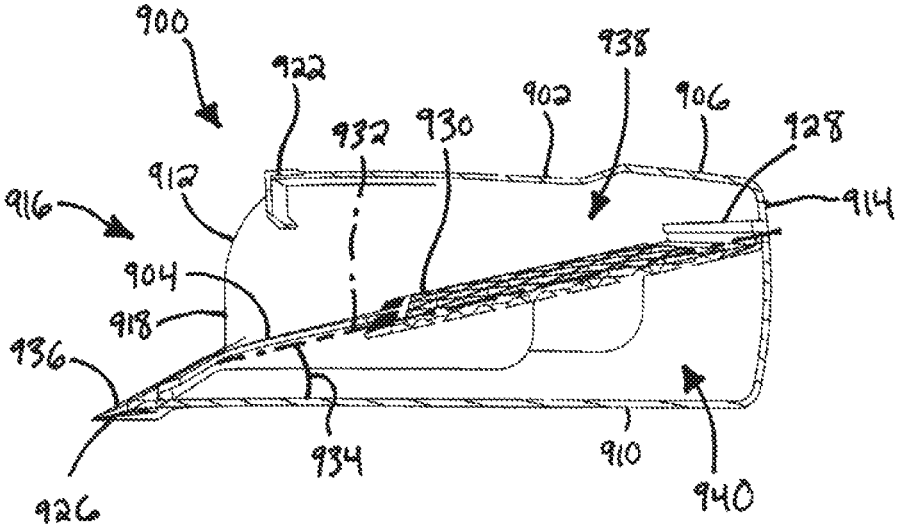
FIG. 9E is a side sectional perspective view of the waste-receiving device of FIG. 9A; the section plane bisects the waste-receiving device.

In some embodiments and as shown specifically in FIG. 9E, the base wall 914 may include a ledge 928 for engaging, positioning, and securing the panel 904 within the chamber 916.

Still referring specifically to FIG. 9E, the panel 904 is disposed within the chamber 916 of the body 902. A first, or upper, surface 930 of the panel 904 is generally disposed in plane 932 that is disposed at an acute angle 934 relative to the lower sidewall 910. In some embodiments and as shown in the drawings, the acute angle 934 is in a range of 5 degrees to 20 degrees. In some embodiments, the plane 932 may be substantially coplanar (that is, coplanar±10 degrees) with an upper surface 936 of the guide ramp 926. In other embodiments, the panel 904 may be disposed in other orientations relative to features of the body 902. In some embodiments and as shown in the drawings, the panel 904 is detachably coupled to the body 902 to facilitate, for example, removing the panel 904 from the body 902 and washing the panel 904 to remove waste. In other embodiments, the panel 904 is non-detachably coupled to the body 902. In some embodiments and as shown in the drawings, the panel 904 is disposed such that it divides the chamber 916 into a first waste-receiving portion 938 on a first side of the panel 904 and a second waste-receiving portion 940 on a second side of the panel 904.

Figure 10A:
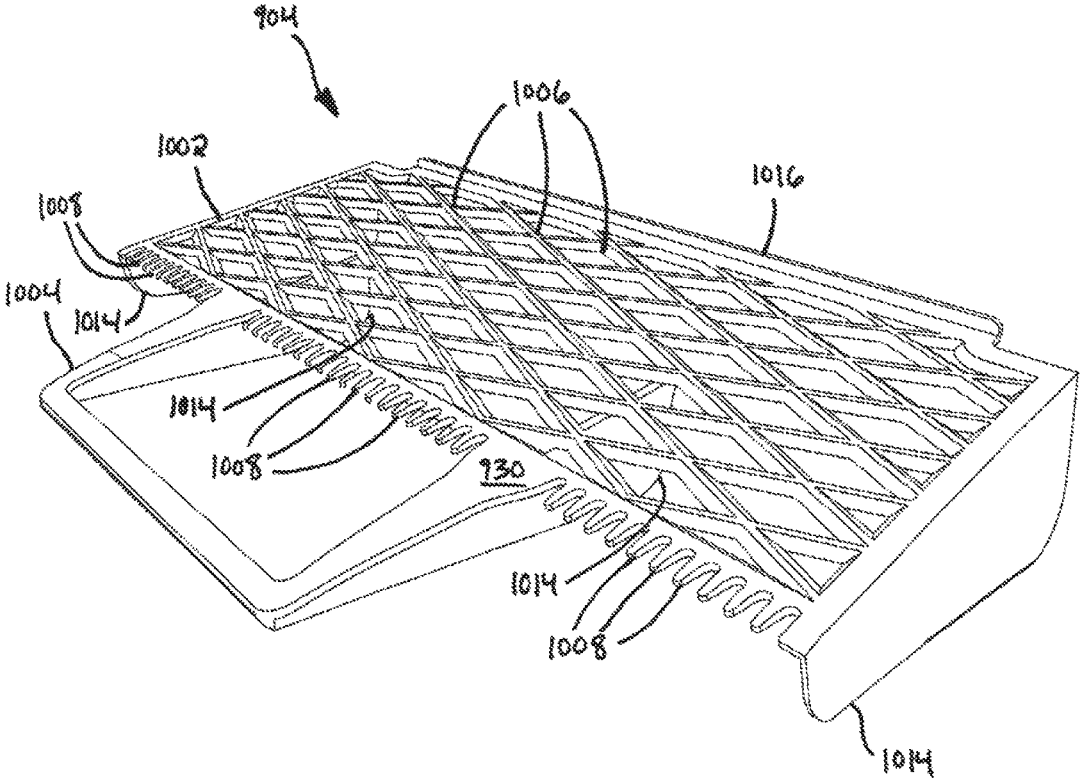
FIG. 10A is a front perspective view of a panel, according to an embodiment of the present disclosure, of the waste-receiving device of FIG. 9A.
Figure 10B:
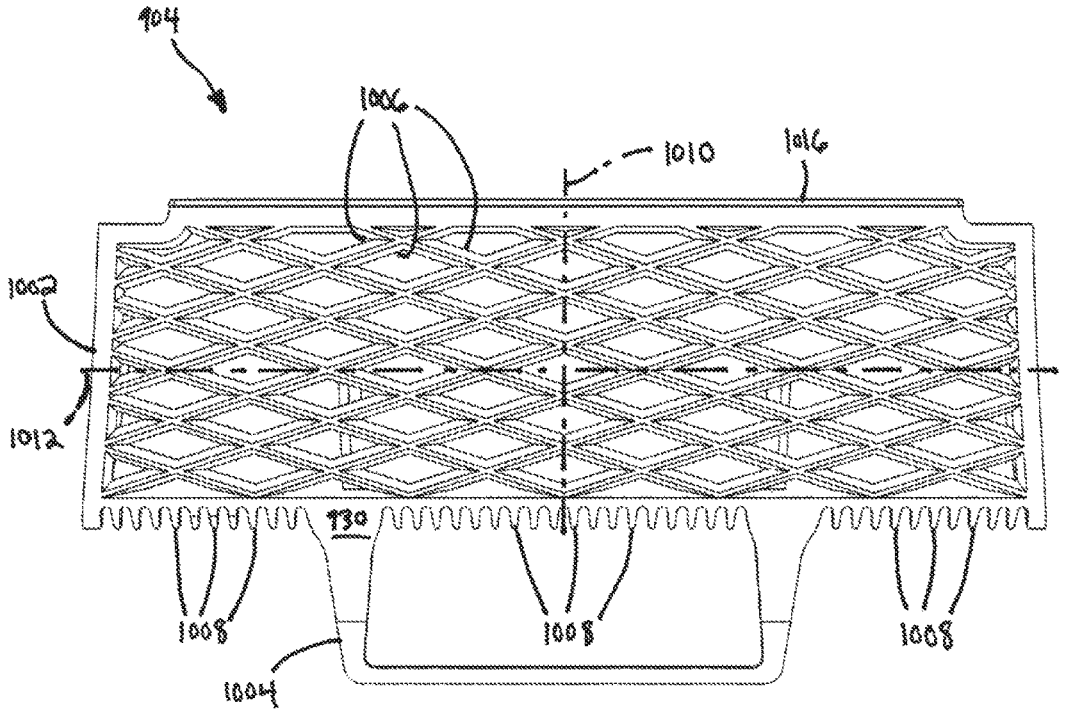
FIG. 10B is another front perspective view of the panel of FIG. 10A.
Figure 10C:
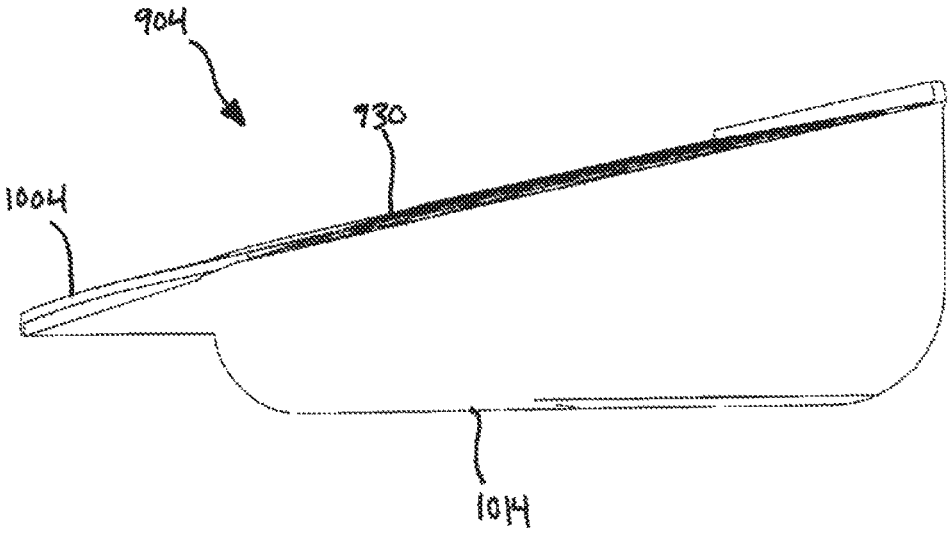
FIG. 10C is a side perspective view of the panel of FIG. 10A.

FIGS. 10A-10C illustrate the panel 904 separately from the other components of the waste-receiving device 900. The panel 904 includes a perimeter 1002 that couples to a handle 1004. The handle 1004 may be grasped by a user to remove the panel 904 from the chamber 916. In some embodiments and as shown in the drawings, the handle 1004 engages, and is removeably secured by, the guide ramp 926 and defines, in part, the upper surface 930 of the panel 904. As such, the handle 1004 and the guide ramp 926 may include substantially coplanar surfaces for directing a sweeping device into an appropriate position within the chamber 916.

The perimeter 1002 also couples to a plurality of cleaning elements that are configured to engage the head of a sweeping device to clean the sweeping device when the sweeping device moves across the upper surface 930 of the panel 904. In some embodiments and as shown in the drawings, the cleaning elements include a plurality of apertures 1006 that extend through the panel 904 and a plurality of teeth 1008 disposed at an edge of the panel 904 adjacent the handle 1004. When the panel 904 is disposed within the chamber 916, the teeth 1008 are disposed between the apertures 1006 and the opening 918.

The apertures 1006 are configured to receive flexible arms of a head of a sweeping device when the head is disposed within the chamber 916 (specifically, the first waste-receiving portion 938 of the chamber 916). The head of a sweeping device may be moved back and forth relative to the panel 904 to cause the flexible arms to exit and enter the apertures 1006, thereby cleaning the flexible arms.

In some embodiments and as shown in the drawings, the portions of the panel 904 that define the apertures 1006 also define, in part, the upper surface 930 of the panel 904. As such, these portions of the panel 904, the handle 1004, and the guide ramp 926 may include substantially coplanar surfaces for directing a sweeping device into an appropriate position within the chamber 916.

In some embodiments and as shown in the drawings, the apertures 1006 each have a diamond shape. The apertures 1006 may each have a height (that is, a dimension in a longitudinal direction 1010, or a direction generally extending toward and away from the opening 918; see FIG. 10B) in a range of 0.5 inches to 1.0 inches. The apertures 1006 may each have a width (that is, a dimension in a transverse direction 1012, or a direction perpendicular to the longitudinal direction 1010; see FIG. 10B) in a range of 1.0 inches to 1.5 inches. In some embodiments and as shown in the drawings, the apertures 1006 each have beveled edges. In some embodiments and as shown in the drawings, the apertures 1006 are arranged in a pattern.

The apertures 1006 may take various other forms. For example, the apertures 1006 may each have a different shape, such as a rectangular shape, a circular shape, an oval shape, a triangular shape, or the like. As another example, one or more of the apertures 1006 may have different shapes than one or more other apertures 1006. As another example, one or more of the apertures 1006 may have different dimensions than one or more other apertures 1006. As another example, one or more of the apertures 1006 may have non-beveled edges. As yet another example, one or more of the apertures 1006 may be arranged randomly relative other apertures 1006 (that is, not arranged in a pattern).

The teeth 1008 are configured to engage the head of a sweeping device when the head moves across the upper surface 930 of the panel 904. The teeth 1008 thereby clean the sweeping device.

In some embodiments and as shown in the drawings, the teeth 1008 also define, in part, the upper surface 930 of the panel 904. As such, the teeth 1008, the portions of the panel 904 that define the apertures 1006, the handle 1004, and the guide ramp 926 may include substantially coplanar surfaces for directing a sweeping device into an appropriate position within the chamber 916.

In some embodiments and as shown in the drawings, the teeth 1008 each have a shape that tapers inwardly proceeding away from the perimeter 1002 of the panel 904. In some embodiments and as shown in the drawings, the teeth 1008 each have an average width (that is, the average of the maximum and minimum widths, in the transverse direction 1012) in a range of 0.0625 inches to 0.25 inches. In some embodiments and as shown in the drawings, the teeth 1008 may be disposed apart in the transverse direction 1012 by a distance in a range of 0.25 inches to 0.625 inches.

The teeth 1008 may take various other forms. For example, one or more of the teeth 1008 may not taper. As another example, one or more of the teeth 1008 may have a different average width than one or more other teeth 1008. As another example, one or more of the teeth 1008 may be disposed apart in the transverse direction 1012 by a different distance than other teeth 1008.

In some embodiments and as shown in the drawings, the panel 904 may include one or more features that facilitate appropriately positioning the panel 904 within the chamber 916. Specifically, the panel 904 may include one or more plates 1014 (more specifically, four plates 1014) that extend away from the perimeter 1002 and engage the lower sidewall 910 of the body 902. Additionally or alternatively, the panel 904 may include a foot 1016 that engages the ledge 928 of the base wall 914 of the body 902.

Figure 11:
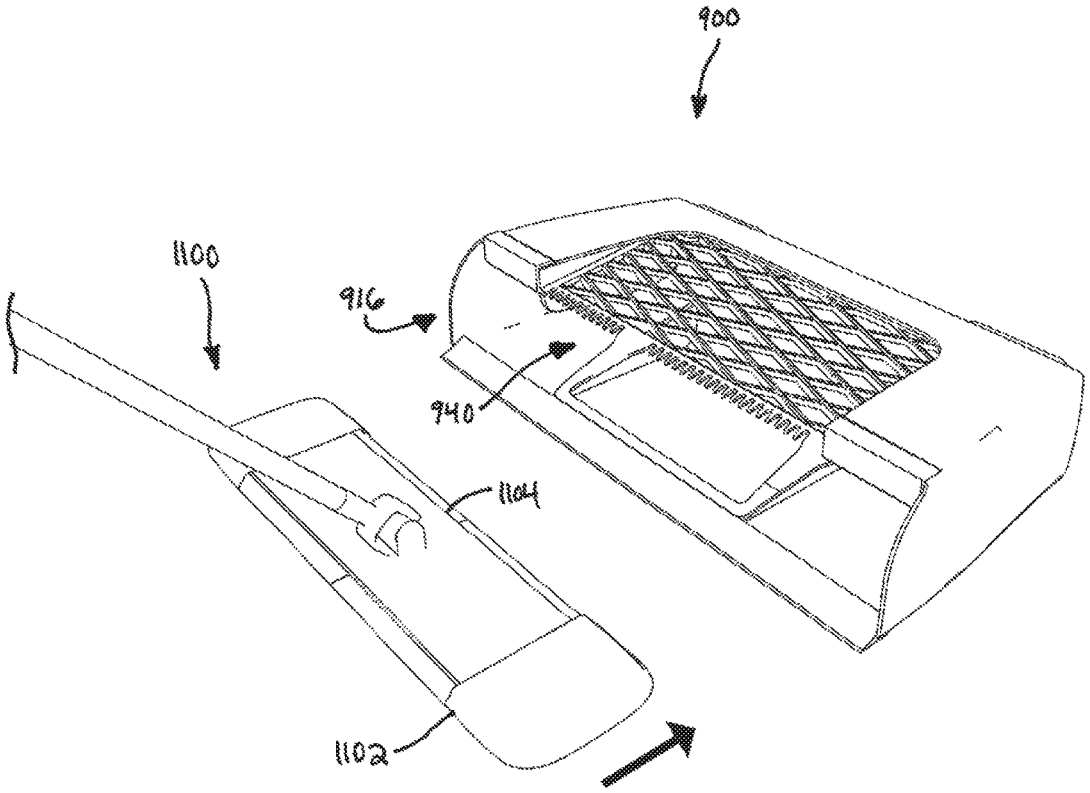
FIG. 11 is a partial front perspective view of the waste-receiving device of FIG. 9A and a sweeping device, according to an embodiment of the present disclosure, moving waste into the waste-receiving device.

FIG. 11 illustrates the waste-receiving device 900 being used with a sweeping device 1100. The sweeping device 1100 may be the sweeping device 100, or the sweeping device 1100 may be different than the sweeping device 100. More specifically, the sweeping device 1100 may include a single cleaning component 1102 on the head 1104, such as a plurality of flexible arms formed from a microfiber material. In FIG. 11, the sweeping device 1100 is moved across the floor surface to move waste toward the chamber 916 of the waste-receiving device 900 (specifically, the second waste-receiving portion 940 of the chamber 916).

Figure 12:
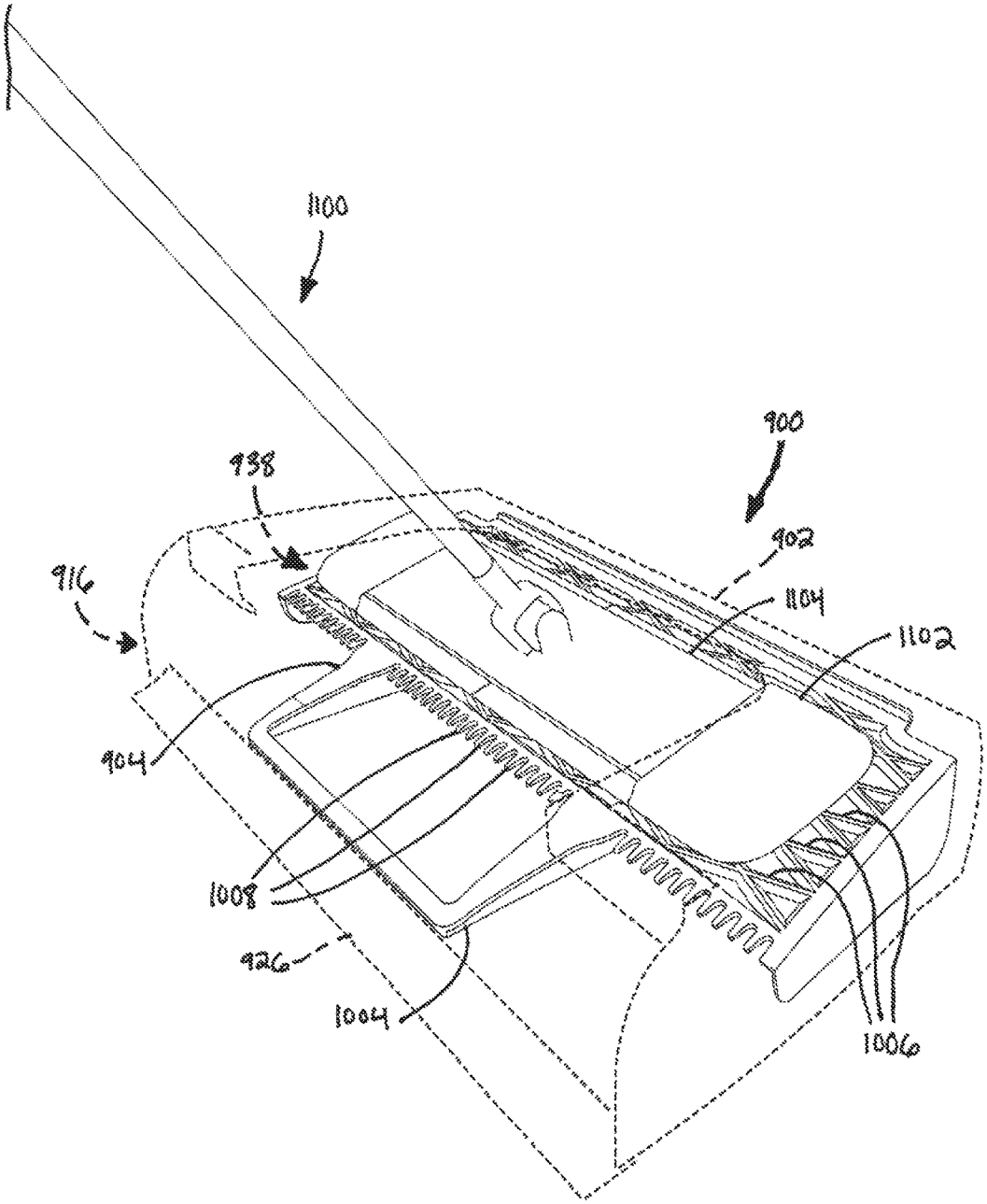
FIG. 12 is a partial front perspective view of the waste-receiving device of FIG. 9A receiving the sweeping device of FIG. 11.

FIG. 12 illustrates the waste-receiving device 900 (the body 902 is shown in hidden lines for clarity) receiving the sweeping device 1100 after the head 1104 of the sweeping device 1100 has moved across the ramp 926, the handle 1004, the teeth 1008, and some of the apertures 1006. The head 1104 of the sweeping device 1100 is positioned in the chamber 916 of the body 902 (specifically, the first waste-receiving portion 938 of the chamber 916) such that the flexible arms of the cleaning component 1102 are received in the apertures 1006 of the panel 904. The head 1104 of the sweeping device 1100 is moved back and forth, or up and down, relative to the panel 904 to clean the cleaning component 1102.

Figure 13:
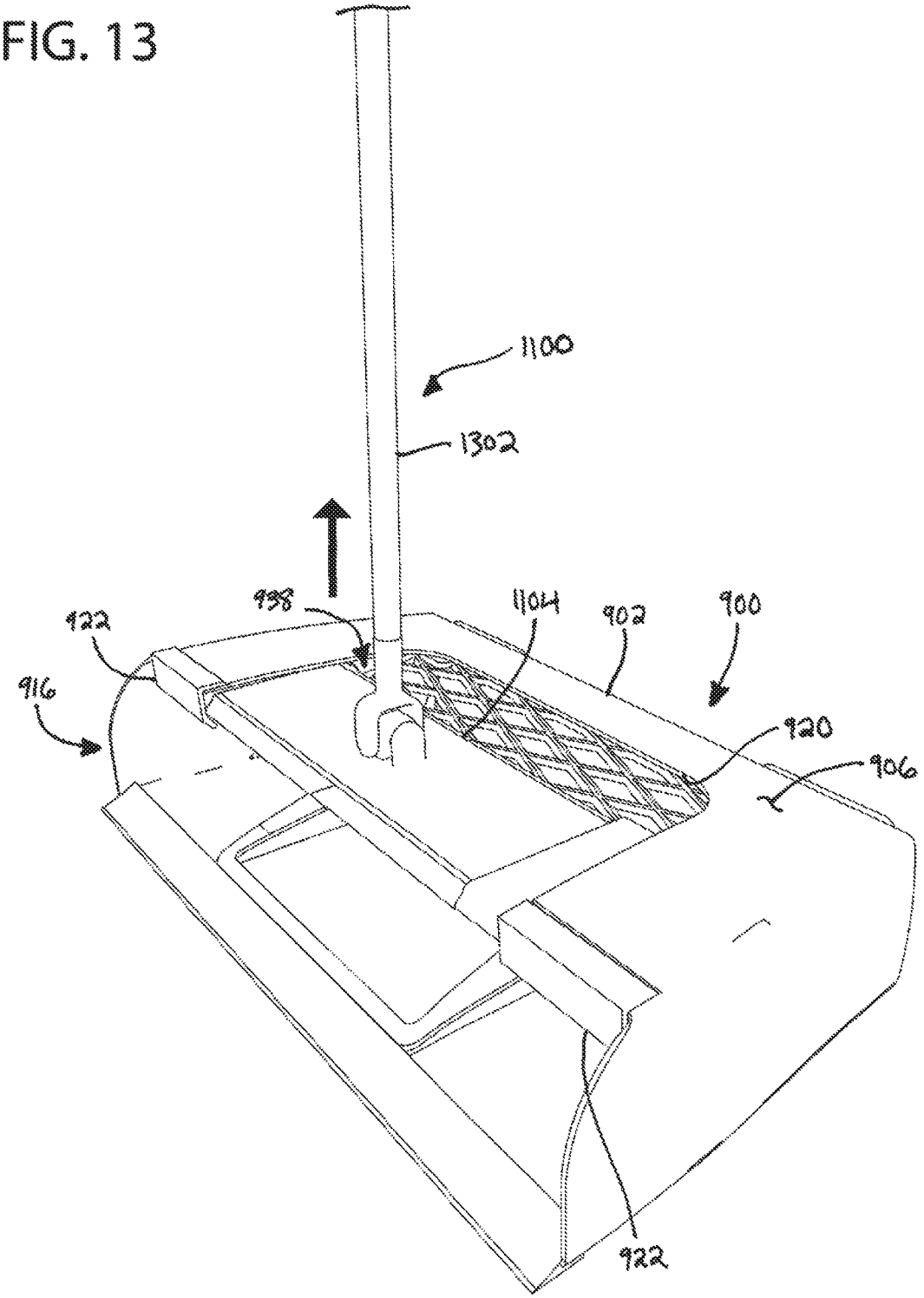
FIG. 13 is a partial front perspective view of the waste-receiving device of FIG. 9A receiving the sweeping device of FIG. 11 and the sweeping device lifting the waste-receiving device.

FIG. 13 illustrates the waste-receiving device 900 receiving the sweeping device 1100 and the sweeping device 1100 lifting the waste-receiving device 900. More specifically, the waste-receiving device 900 may be lifted when the sweeping device 1100 is positioned in the first waste-receiving portion 938 of the chamber 916 of the body 902 and the handle 1302 of the sweeping device 1100 extends through the cut-out portion 920 of the upper sidewall 906 by lifting the handle 1302 of the sweeping device 1100. That is, the head 1104 of the sweeping device 1100 engages the upper sidewall 906 to lift the waste-receiving device 900 with the sweeping device 1100, and the waste-receiving device 900 and the sweeping device 1100 may then be moved together. In some embodiments, one or more of the L-shaped brackets 922 engage the head 1104 to inhibit the head 1104 from exiting the chamber 916.

Figure 14:
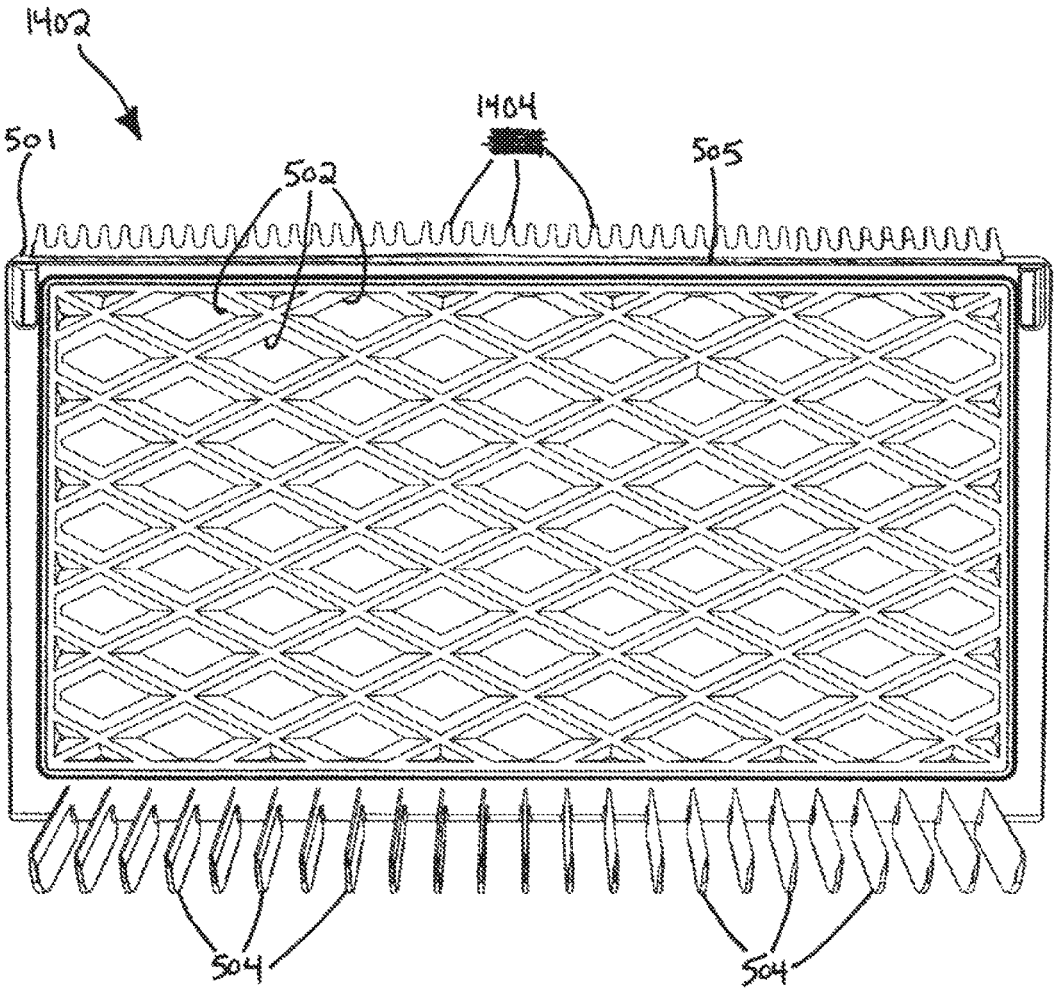
FIG. 14 is a front perspective view of a panel of a waste-receiving device, according to an embodiment of the present disclosure.

FIG. 14 illustrates a panel 1402 according to an embodiment of the present disclosure. The panel 1402 may be used, for example, with the waste-receiving device 200 instead of the panel 206. The panel 1402 includes similar features as the panel 206. Specifically, the panel 1402 includes a perimeter 501, a plurality of apertures 502, a plurality of lower teeth 504, and an upper edge 505. Additionally, the panel 1402 includes a plurality of upper teeth 1404 coupled to the upper edge 505. The upper teeth 1404 facilitate cleaning the first cleaning component 106 and the second cleaning component 108 when the head 104 of the sweeping device 100 enters the chamber 226 of the waste-receiving device 200. The upper teeth 1404 may have various dimensions, such as the dimensions of any of the other teeth described herein.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above described features.

What is claimed is:

1. A waste-receiving device for use with a sweeping device, the waste-receiving device comprising:

a body comprising:

a chamber configured to receive waste therein;

an opening coupled to the chamber, the opening permitting the sweeping device to enter into the chamber; and a panel disposed within the chamber and having an upper edge, the panel comprising a plurality of apertures and a plurality of teeth coupled to the upper edge of the panel that are configured to engage the sweeping device and the plurality of apertures configured to receive a cleaning component carried by the sweeping device to facilitate separating waste from the cleaning component.

2. The waste-receiving device of claim 1, wherein the panel further comprises a plurality of teeth configured to engage the sweeping device and facilitate separating waste from the sweeping device.

3. The waste-receiving device of claim 2, wherein the plurality of teeth are disposed on the panel such that the plurality of teeth are configured to engage a plurality of bristles of the sweeping device.

4. The waste-receiving device of claim 2, wherein the plurality of teeth are disposed between the plurality of apertures and the opening.

5. The waste-receiving device of claim 2, wherein the plurality of teeth are disposed at an edge of the panel.

6. The waste-receiving device of claim 5, wherein the edge of the panel is a nearest edge to the opening.

7. The waste-receiving device of claim 2, wherein the panel defines a plane, and the plurality of teeth extend from the plane at an obtuse angle.

8. The waste-receiving device of claim 1, wherein each of the plurality of apertures comprises a diamond shape.

9. The waste-receiving device of claim 1, wherein the plurality of apertures are arranged in a pattern on the panel.

10. The waste-receiving device of claim 1, wherein the body further comprises:

plurality of sidewalls defining the opening; and a base detachably coupled to the sidewalls, the base and the sidewalls together defining the chamber.

11. The waste-receiving device of claim 10, wherein the panel is disposed between the base and the opening.

12. The waste-receiving device of claim 10, wherein the base comprises a leg configured to engage a floor surface and facilitate standing the waste-receiving device.

13. The waste-receiving device of claim 1, wherein the panel is removeably disposed within the chamber.

14. The waste-receiving device of claim 1, wherein the body further comprises a leg configured to engage a floor surface and facilitate standing the waste-receiving device.

15. The waste-receiving device of claim 1, further comprising a handle pivotably coupled to the body.

16. The waste-receiving device of claim 15, wherein the handle comprises a concave surface for selectively receiving a handle of the sweeping device.

17. The waste-receiving device of claim 1, further comprising a handle pivotably coupled to the body, wherein the body further comprises:

plurality of sidewalls defining the opening and pivotably coupled to the handle; and a base detachably coupled to the sidewalls, the base and the sidewalls together defining the chamber.

18. A waste-receiving device for use with a sweeping device, the waste-receiving device comprising:

a body comprising:

a chamber configured to receive waste therein;

an opening coupled to the chamber, the opening permitting the sweeping device to enter into the chamber; and a panel disposed within the chamber, including an upper edge, and dividing the chamber into a first waste-receiving portion and a second waste-receiving portion, the panel comprising a plurality of teeth coupled to the upper edge of the panel, and the panel configured to engage the sweeping device and the plurality of teeth configured to engage a cleaning component carried by the sweeping device to facilitate separating waste from the cleaning component.

19. The waste-receiving device of claim 18, further comprising a handle pivotably coupled to the body.

* * * * *